US011248779B1

(12) United States Patent
Irons et al.

(10) Patent No.: US 11,248,779 B1
(45) Date of Patent: Feb. 15, 2022

(54) LED LINEAR LUMINAIRE

(71) Applicant: Elemental LED, Inc., Reno, NV (US)

(72) Inventors: Travis Irons, Reno, NV (US); Adam L Pruitt, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/243,970

(22) Filed: Apr. 29, 2021

Related U.S. Application Data

(60) Provisional application No. 63/130,521, filed on Dec. 24, 2020.

(51) Int. Cl.

| | |
|---|---|
| ***F21V 23/00*** | (2015.01) |
| ***F21S 4/28*** | (2016.01) |
| ***F21V 23/06*** | (2006.01) |
| ***F21Y 103/10*** | (2016.01) |
| ***F21Y 115/10*** | (2016.01) |

(52) U.S. Cl.
CPC ..... *F21V 23/005* (2013.01); *F21S 4/28* (2016.01); *F21V 23/002* (2013.01); *F21V 23/06* (2013.01); *F21Y 2103/10* (2016.08); *F21Y 2115/10* (2016.08)

(58) Field of Classification Search
CPC ..... F21S 4/28; F21S 4/20; F21S 2/005; F21V 23/005; F21V 23/002; F21V 23/06
See application file for complete search history.

(56) References Cited

U.S. PATENT DOCUMENTS

| | | | | |
|---|---|---|---|---|
| 10,028,345 | B2 | 7/2018 | Petersen et al. | |
| 10,801,716 | B1 | 10/2020 | Lopez-Martinez et al. | |
| 10,897,802 | B1 | 1/2021 | Avery, Jr. | |
| 10,928,017 | B1 | 2/2021 | Avery, Jr. | |
| 2009/0135597 | A1* | 5/2009 | Kay | F21K 9/00 362/247 |
| 2009/0207602 | A1* | 8/2009 | Reed | F21S 2/005 362/225 |
| 2009/0225546 | A1* | 9/2009 | Pearson | F21V 29/767 362/249.06 |

(Continued)

OTHER PUBLICATIONS

U.S. Appl. No. 17/243,914, filed Apr. 29, 2021, Avery, Jr., Entire document.

(Continued)

*Primary Examiner* — William N Harris
(74) *Attorney, Agent, or Firm* — United IP Counselors, LLC

(57) ABSTRACT

A linear luminaire includes a channel with a bottom and sidewalls that arise from opposite sides of the bottom. The channel has an upper compartment and a lower compartment, the sidewalls being of a shape and extent such that at opposite ends of the channel, the upper compartment overhangs the lower compartment in a longitudinal direction. An elongate, rigid printed circuit board (PCB) is mounted in the upper compartment of the channel, aligned along the longitudinal direction, the PCB extending to each of the opposite ends of the channel in the upper compartment and having one or more LED light engines mounted thereon. The PCB may be mounted on stand-offs, such that it is above the bottom of the channel and defines the boundary between the upper and lower compartments. The overhung upper compartment creates a cableway space when two linear luminaires are abutted end-to-end or are adjacent.

15 Claims, 17 Drawing Sheets

(56) References Cited

U.S. PATENT DOCUMENTS

| | | | | |
|---|---|---|---|---|
| 2010/0277914 | A1* | 11/2010 | Bachl | F21S 4/20 362/249.01 |
| 2012/0092875 | A1* | 4/2012 | Cho | F21S 2/005 362/311.01 |
| 2017/0122507 | A1* | 5/2017 | Hoffman | H05B 47/18 |
| 2017/0292664 | A1* | 10/2017 | Pearson | F21V 29/70 |
| 2017/0292683 | A1* | 10/2017 | Kim | F21V 7/04 |
| 2018/0017221 | A9* | 1/2018 | Pearson | F21V 21/088 |
| 2018/0031189 | A1* | 2/2018 | Pearson | F21V 29/70 |
| 2020/0158297 | A1* | 5/2020 | Rosenbauer | F21S 4/28 |
| 2021/0048157 | A1* | 2/2021 | Macallen | F21V 21/005 |

OTHER PUBLICATIONS

U.S. Appl. No. 17/244,019, filed Apr. 29, 2021, Irons, et al., Entire document.

* cited by examiner

LED LINEAR LUMINAIRE

TECHNICAL FIELD

The invention relates to linear lighting and, more specifically, to linear luminaires.

BACKGROUND

Linear lighting is a class of lighting in which an elongate, narrow printed circuit board (PCB) is populated with light-emitting diode (LED) light engines, typically spaced from one another at a regular spacing or pitch. The PCB may be either flexible or rigid. Although a strip of linear lighting is a microelectronic circuit on a PCB, for various reasons, lighting circuits are usually kept simple, often no more than the LED light engines and an element or elements to set the current in the circuit, typically a resistor or a current-source integrated circuit. Combined with an appropriate power supply, linear lighting is considered a luminaire in its own right, although it is frequently used as a raw material in the construction of more complex luminaires.

Linear luminaires, i.e., finished light fixtures based on linear lighting, are often made by placing a strip of linear lighting in a channel and covering it with a cover. The channels are typically extrusions, with a constant cross-sectional shape, and in most cases, the strip of linear lighting is mounted directly on the bottom or one of the sidewalls of the channel. Most channels are made of a metal, such as anodized aluminum, although some channels may be made of plastic. The ends of a channel are typically capped with endcaps.

The channel in a linear luminaire serves several functions. First and foremost, it provides some protection from dirt, dust, and the elements. Second, depending on the particular application, the channel cover may diffuse and direct the light emitted by the linear lighting. Finally, linear lighting generates heat, and the channel may act as a heat sink.

As linear luminaires have become more prevalent in the market, they are often called upon to perform in more and more extreme environments, for example, weathering long outdoor exposures. Moreover, while many designers and consumers were once content to save energy merely by switching from incandescent, neon, or fluorescent lighting to LED lighting, modern designers and consumers expect better energy efficiency from modern linear luminaires, as well as greater functionality and more control over that functionality.

BRIEF SUMMARY

One aspect of the invention relates to a linear luminaire. The linear luminaire has a channel, which has a bottom and a pair of sidewalls that arise from the bottom, giving the channel a U-shape in cross-section. An elongate printed circuit board (PCB) is mounted on stand-offs above the bottom, leaving a lower compartment or portion of the channel open. The PCB has a plurality of LED light engines mounted on it, and those LED light engines may be spaced at a close pitch along the length of the PCB. The PCB may be rigid, made, for example, of aluminum, FR4, or another such material. The mounting of the PCB causes it to extend within an upper compartment or portion of the channel. At its ends, the upper compartment of the channel overhangs the lower compartment. That is, the upper compartment of the channel extends beyond the lower compartment. The PCB has an extent such that it ends almost exactly at the ends of the upper compartment of the channel. With this arrangement, several linear luminaires can be placed end-to-end with virtually no dark spots or light holes between them. The open lower compartment of the linear luminaire provides a raceway for wiring, and to the extent that wiring passes between adjacent linear luminaires, it is shielded from view by the overhung upper compartments of the adjacent linear luminaires.

Another aspect of the invention relates to drive circuits for linear luminaires. In a drive circuit according to this aspect of the invention, several series of LED light engines are connected in parallel to voltage and, through a driver integrated circuit (IC), to ground. The series of LED light engines may be of the same type or of different types, and thus, the series of LED light engines may take the same voltage or different voltages. Typically, series of LED light engines that take the same voltage are grouped together. The driver IC sets the current in each series of LED light engines. Power supply circuits under the control of one or more power control ICs take an input voltage and supply the voltages needed to activate the series of LED light engines and other electronic components. In each series, the voltage remaining after the last LED light engine in the series is detected and sent into a power feedback circuit coupled to the one or more power control ICs. The power feedback circuit provides a feedback signal to the power control ICs that causes the voltage applied to the series of LED light engines to be increased or decreased. In some cases, the power feedback signal may be generated by an integrator. This may have the effect of compensating for variations in the forward voltages of the various LED light engines.

In some embodiments according to this aspect of the invention, the driver IC may modulate the power applied to the series of LED light engines with a pulse-width modulation (PWM) signal, such as a PWM current signal. In this case, each series of LED light engines may have a parallel leg that connects after cathode of the last LED light engine in the series. The parallel leg may have a filter, such as an RC low-pass filter, that filters out the PWM modulation so that a generally steady-state remaining voltage can be detected and sent to the power feedback circuit. Based on the remaining voltage, the applied voltage may be increased or decreased to ensure that the driver IC receives at least a threshold minimum voltage.

Yet another aspect of the invention also relates to drive circuits for linear luminaires. In a drive circuit according to this aspect of the invention, at least one series of LED light engines is arranged between voltage and ground. A driver IC sets the current in the series of LED light engines. A switching element, such as a bipolar junction transistor (BJT) is arranged between the series of LED light engines and the driver IC such that its collector is connected to the series of LED light engines and its emitter is connected to the driver IC. When the driver IC sets the current in the series of LED light engines to a nonzero value, a steady voltage supplied to the base of the BJT allows power to flow between collector and emitter. When the driver IC sets the current in the series of LED light engines to zero, the voltage at the base of the BJT trends toward zero, such that the BJT does not allow power to flow and protects the driver IC from high voltages. The driver IC may modulate the power applied to the series of LED light engines with a pulse-width modulation (PWM) signal.

A further aspect of the invention relates to control methods for luminaires. In one method using the kind of drive circuits described above, a particular drive circuit has a fixed power budget. When instructions to activate one or more series of LED light engines are received, a central unit of the drive circuit examines the instructions, determines if any available series of LED light engines will be unused when the instructions are executed, and if so, reallocates the unused power among the series of LED light engines that are or will be active when the instructions are executed.

Yet another further aspect of the invention relates to color transitions in luminaires having LED light engines capable of emitting different color temperatures of white light. In these types of luminaires, if a transition between a first color temperature of white light and a second color temperature of white light is detected, a central unit may alter the transition instructions such that the transition occurs along the Planckian locus.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which:

FIGS. 9-1 and 9-2 are, collectively, a schematic diagram of power circuitry for a linear luminaire, illustrating boost and buck converter circuit topologies with controllers that are responsive to voltage feedback from circuits like those shown in FIGS. 7 and 8;

DETAILED DESCRIPTION

Figure 1:
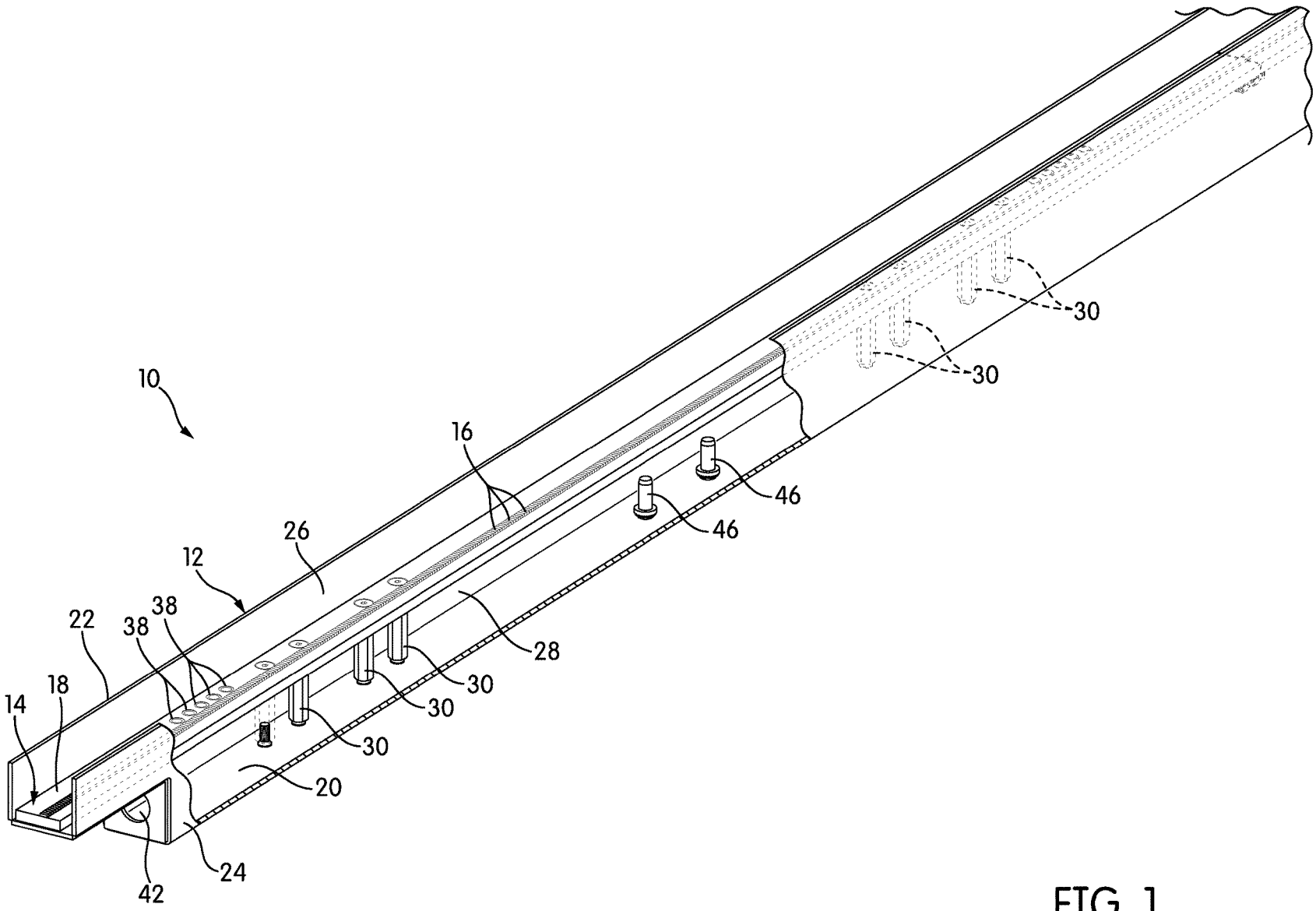
FIG. 1 is a perspective view of a linear luminaire according to one embodiment of the invention.

FIG. 1 is a perspective view of a linear luminaire, generally indicated at 10, according to one embodiment of the invention. The luminaire 10 comprises a channel 12 and a strip of linear lighting 14. The strip of linear lighting 14 includes a plurality of LED light engines 16 disposed linearly along a printed circuit board (PCB) 18.

As the term is used here, "light engine" refers to an element in which one or more light-emitting diodes (LEDs) are packaged, along with wires and other structures, such as electrical contacts, that are needed to connect the light engine to a PCB. LED light engines may emit a single color of light, or they may include red-green-blue (RGBs) that, together, are capable of emitting a variety of different colors depending on the input voltages. If the light engine is intended to emit "white" light, it may be a so-called "blue pump" light engine in which a light engine containing one or more blue-emitting LEDs (e.g., InGaN LEDs) is covered with a phosphor, a chemical compound that absorbs the emitted blue light and re-emits either a broader or a different spectrum of wavelengths. The particular type of LED light engine is not critical to the invention. In the illustrated embodiment, the light engines are surface-mount devices (SMDs) soldered to the PCB 18, although other types of light engines may be used. For reasons that will be explained below in more detail, the LED light engines 16 may include individual red, green, and blue LEDs as well as two color temperatures of "white" LEDs, typically a "cool" white and a "warm" white.

In the illustrated embodiment, the LED light engines 16 are in the form of small, rectangular 2110 surface-mount packages. Such small packages may make it easier to mix and diffuse the resulting light. Of course, other sizes and packages are possible.

Figure 2:
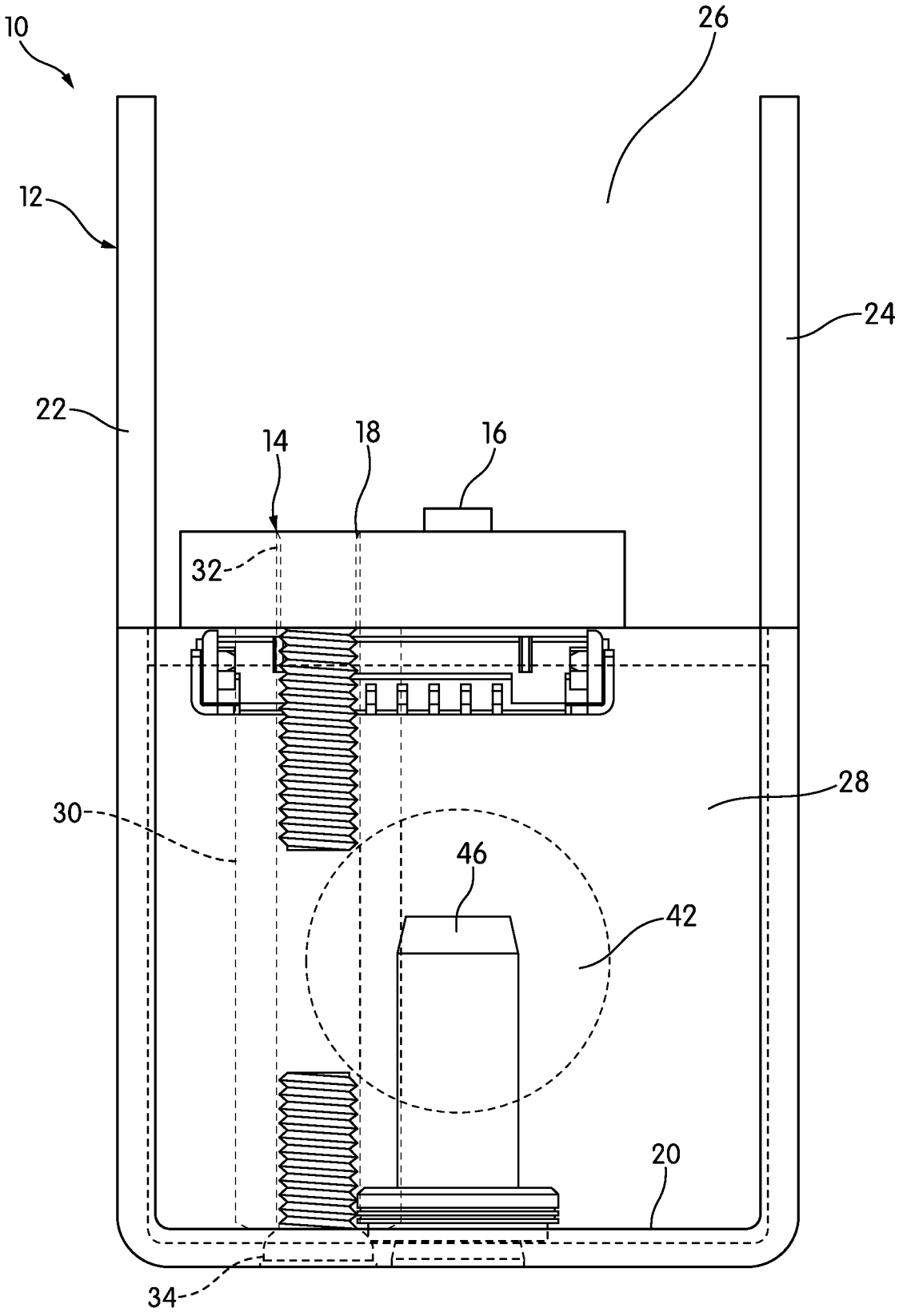
FIG. 2 is a cross-sectional view taken through Line 2-2 of FIG. 1.

The channel 12 has a bottom 20 and a pair of sidewalls 22, 24 that arise from the bottom 20. As shown in FIG. 2, a cross-sectional view taken through Line 2-2 of FIG. 1, the sidewalls 22, 24 are straight-sided in the illustrated embodiment, making rounded corners where they meet the bottom 20 and giving the channel 12 a U-shape as viewed in cross-section or from one of the ends. The channel 12 also has an upper portion 26 and a lower portion 28. For reasons that will be described below in more detail, the upper portion 26 overhangs and extends out beyond the lower portion 28 at respective ends of the channel 12.

In the illustrated embodiment, the strip of linear lighting 14 has a rigid PCB 18. The PCB 18 may be made of, e.g., FR4 composite material, ceramic, or aluminum, to name a few possible materials. In most linear luminaires, the strip of linear lighting would be mounted to the bottom of the channel, or to one of the sidewalls. That is not the case in the linear luminare 10. Instead, as can best be seen in the perspective view of FIG. 1, the PCB 18 is mounted on a series of stand-offs 30 that are connected directly between the PCB 18 and the bottom 20. (In FIG. 1, a portion of the sidewall 24 is cut away to show the internal configuration of the channel 12.) The stand-offs 30 have sufficient height such that the PCB 18 defines the boundary between the lower portion 28 and the upper portion 26. The stand-offs 30 mount in through holes 32 through the PCB 18 and in through holes 34 through the bottom 20 of the channel 12. The stand-offs 30 of the illustrated embodiment are hollow and threaded along their interior to receive screws or bolts, although rivets and other such securing structure may be used in other embodiments.

In addition to securement and positioning, the stand-offs 30 may serve as heat sinks, connecting the PCB 18 thermally with the channel 12 and serving to draw heat away from the PCB 18.

The PCB 18 is coextensive with the full length of the overhung upper portion 26, terminating essentially where the upper portion 26 terminates. The PCB 18 includes a line of LED light engines 36 that extends to the very ends of the PCB 18. The LED light engines 36 are spaced together at a very close pitch, essentially as close to one another as practical. The line of LED light engines 36 is offset from the centerline of the PCB 18 so as to accommodate the through holes 32 for the stand-offs 30. In addition to the through holes 32 for the stand-offs 30, the PCB 18 has sets of through holes 38 spaced at intervals from one another along its length. In the illustrated embodiment, there are five through holes 38 in each set, aligned linearly with one another, and also in general alignment with the through holes 32 for the stand-offs 30 on the same side of the PCB 18. The sets of through holes 38 provide channels through which wires for power and data can pass. With this arrangement, wires for power and data would pass through the sets of through-holes 38 and be soldered or otherwise connected to solder pads (not shown in the view of FIGS. 1 and 2).

The luminaire 10 is arranged to provide a continuous line of light with as few interruptions (i.e., dark spots) as possible. Several features contribute to this. First, as noted above, the LED light engines 16 are spaced closely together, in this case typically 0.030 inches (0.762 mm) apart. Additionally, the overhung upper compartment 26 may contribute to this in some embodiments.

All channels 12 used for the luminaire 10 and for other linear luminaires have a finite maximum length. For example, for shipping and handling reasons, channels 12 may be limited in length to approximately 8 feet (2.4 meters). If a longer luminaire is needed, individual luminaires are placed end-to-end. When two typical luminaires are abutted end-to-end, there can be a gap, and thus, a dark spot, between the end of one luminaire and the beginning of the next. Several factors contribute to this gap, including endcaps in the ends of the luminaires and space needed between adjacent luminaires to allow for the passage of cables and wires.

Figure 3:
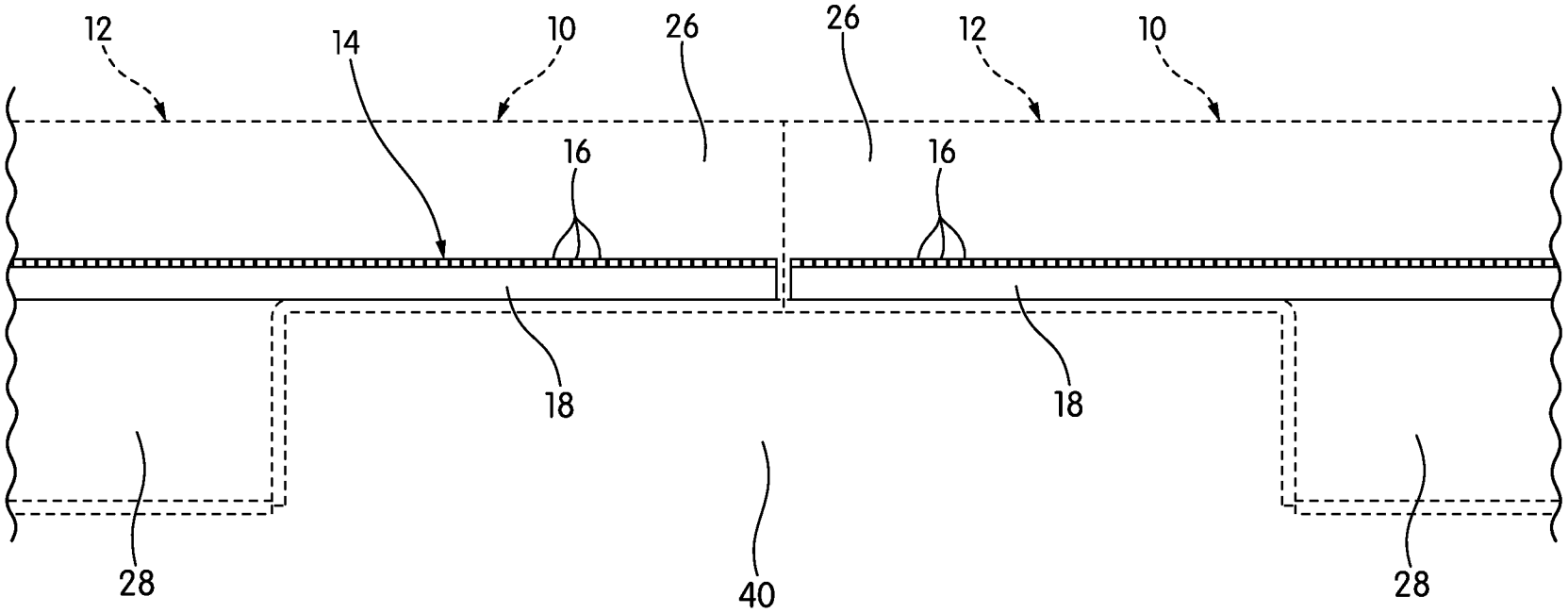
FIG. 3 is a side elevational view of two linear luminaires abutted end-to-end.

The luminaire 10 is designed to reduce the gap between adjacent luminaires 10 as much as possible when two luminaires 10 are abutted end-to-end. FIG. 3 is a side elevational view of two luminaires 10 abutted end-to-end. As will be described below in more detail, the design of the luminaires 10 may allow the luminaires to be without endcaps. However, as can also be appreciated from FIG. 3, the overhung upper compartments 26 assist in producing a gapless spacing between adjacent luminaires 10. As shown, the upper compartments 26 abut in FIG. 3, while the lower compartments 28 stop well short of the extent of the upper compartments 26. The linear lighting 14 comes to the edge or almost to the edge of each upper compartment 26.

The overhung upper compartments 26 and shorter lower compartments 28 leave a space 40 between the two luminaires 10, i.e., a space between adjacent lower compartments 28, for the insertion of cables and wires. That space 40 may serve as a cableway, permitting wires or cables from one luminaire 10 to be connected to wires or cables from the abutted or adjacent luminaire 10. Any cables or wires that may be in the cableway space 40, are shielded from view by the abutted upper compartments 26. The two lower compartments 28 each have openings, or knock-outs for openings 42, at their ends, allowing cables and wires to enter the cableway space 40, as can be seen in FIG. 2.

Figure 4:
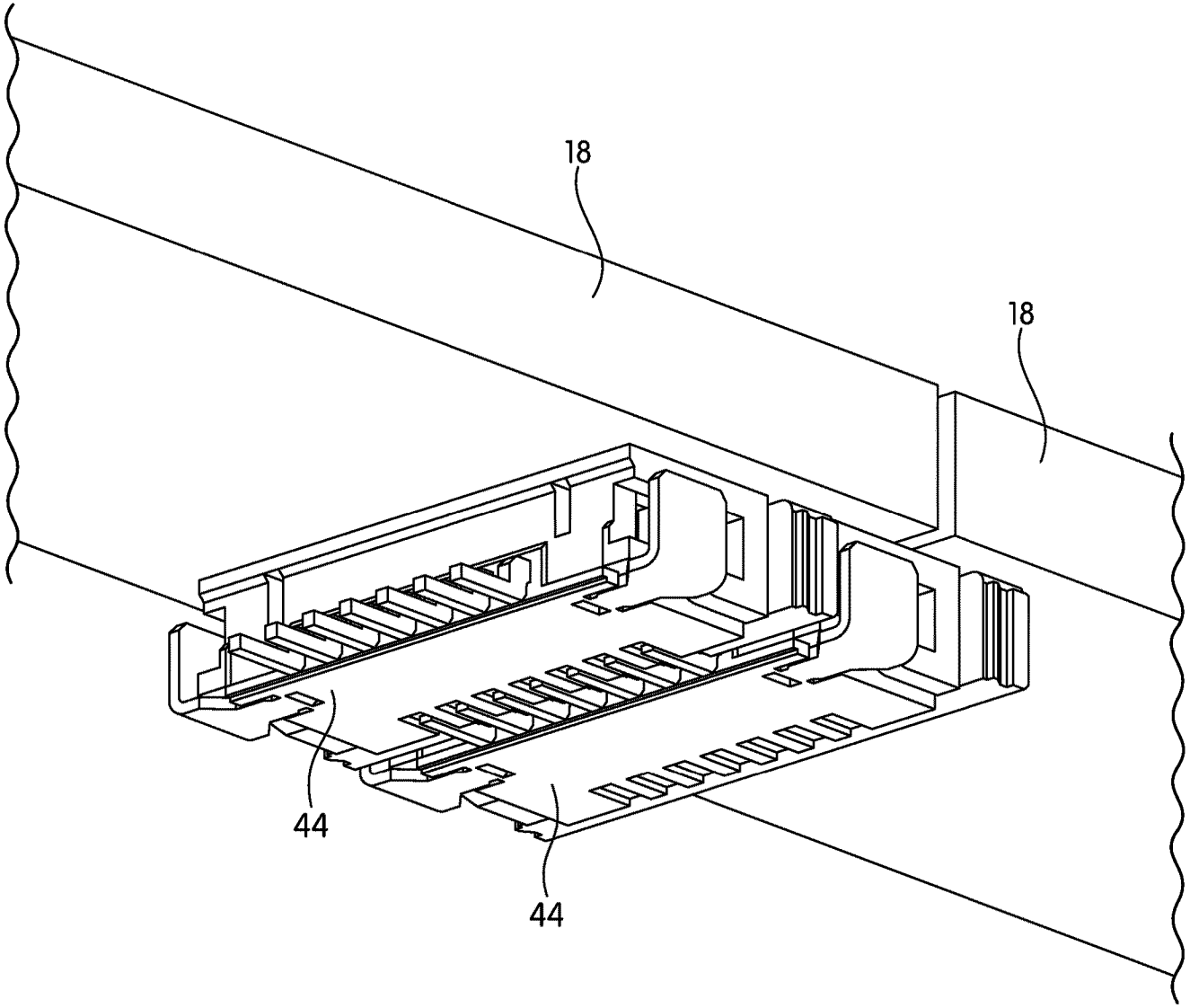
FIG. 4 is a perspective view of the underside of two adjacent printed circuit boards, illustrating harnesses or electrical connectors that connect between them.

In embodiments of the luminaire 10, the linear lighting 14 may be made to particular lengths that are shorter than the channels 12 in which they are to be placed. For that reason, individual lengths of linear lighting 14 may be joined together using harnesses or electrical connectors 44 to bring the power and control signals from one length of linear lighting 14 to the next. FIG. 4 is a perspective view of the underside of two adjacent PCBs 18, illustrating their joinder with connectors 44. The connectors 44 would typically be press-fit connectors, although any type of connectors 44 may be used. The placement of the connectors 44 on the underside of the PCBs 18 prevents the connection from obscuring or obstructing the light output. Additionally, as shown, one connector 44 extends past the end of its PCB 18 while the complementary connector 44 is set back from the end of its PCB 18. This allows for a connection with no gap between adjacent strips of linear lighting 14. Connectors 44 like those shown in FIGS. 2 and 4 may be used between strips of linear lighting 14 in the same channel 12, and they may also be used to electrically connect two adjacent luminaires 10 in some cases.

Most linear luminaires include a cover on the channel that serves to cover and protect the linear lighting. As was described briefly above, the ends of channels may be capped with endcaps in order to close off the channel entirely. Linear luminaires 10 according to embodiments of the invention may use these elements.

However, the illustrated embodiment of the linear luminaire 10 is designed to be entirely encapsulated with a resin. Resin encapsulation is more likely than covers and endcaps to provide complete protection for the linear lighting 14 while at the same time providing other benefits, like heat transmissibility. Fully encapsulated by resin, a linear luminaire 10 may have a high ingress protection (IP) rating, up to and including IP68, a rating which permits full submersion of the luminaire 10 for some period of time.

U.S. Pat. No. 10,801,716 to Lopez-Martinez et al., the work of the present assignee, describes procedures for resin encapsulation of linear lighting, and is incorporated by reference in its entirety. For purposes of this description, the terms "resin encapsulation" and "potting" are used interchangeably. The linear luminaire 10 may be potted using a polyurethane resin, a silicone resin, or any other suitable resin. In a typical potting operation, the channel 12 would act as a mold for the resin, and the ends of the channel 12 may be capped or blocked temporarily to allow for the inpour of resin. Ports 46 in the channel 12, shown particularly in FIG. 2, may be provided at regular intervals to allow for inflow of resin for potting, although in some embodiments, resin may simply be introduced by pouring it into the channel 12 from the top.

As the Lopez-Martinez et al. patent explains, during potting, resin can be deposited in several layers, and cured or partially cured between layers. In encapsulating a linear luminaire 10, resins may be chosen specifically so that the encapsulation of the lower compartment 28 is optimized for heat transfer while the encapsulation of the upper compartment 26 is optimized for light emission. For example, the resin of the lower compartment 28 may be doped with ceramic or metal particles to aid in heat transmission, while the upper compartment 26 may use a clear, transparent resin. The resin of the upper compartment 26 may also be formed into a lens, e.g., a convex lens, a concave lens, etc. by using the meniscus of the liquid material or by filling the upper compartment 26 while capped with a mold. Diffusing additives may be used in the resin if greater light diffusion is desired.

When polymeric resins come into direct contact with light engines 16, the quality of the light emitted by some types of light engines may change. Specifically, in blue-pump LED light engines that are topped with a phosphor, that phosphor is usually held within a silicone polymer matrix. Direct contact between an encapsulating resin and the silicone matrix that holds a phosphor allows more blue light to escape from the LED light engine for refractive reasons, causing a change in the color of the emitted light.

There are a number of different internationally-recognized systems for describing and reporting the color of light emitted from LED light engines. A full description of these systems is not necessary to understand the present invention. For these purposes, it is sufficient to say that the color of so-called "white light" LED light engines is usually described in terms of color temperature, measured in degrees Kelvin. The color temperature scale is a descriptive shorthand that compares the color emitted by a "white" LED light engine to the color of a blackbody radiator—an incandescent object whose color is determined only by its temperature. Stars, like our sun, provide natural light, are considered to be blackbody radiators. We compare artificial light sources, like LED light engines, to the light emitted by stars. For example, LED light engines that provide a "warm" white light with a large proportion of yellow and red in their spectra typically have a color temperature in the range of about 2400K to about 3500K. "Cooler" white LED light engines, with more blue in their spectra, typically have color temperatures in the range of 5000K to 6500K. For reference, the color temperature of sunlight varies throughout the day, but at noon on a clear summer day, the color temperature of sunlight is about 5500K.

The present assignee's own photometric measurements have shown that encapsulation with polyurethane resins can drive an increase in color temperature of several hundred degrees Kelvin, depending on the original color temperature of the LED light engines and the nature of the resin. In other words, significantly more blue light may be emitted by an encapsulated blue-pump "white" LED light engine. However, there may be other shifts as well. For example, the resin material itself may selectively absorb or attenuate certain wavelengths of light, for reasons having to do with its fundamental chemistry. For example, the present assignee has found that encapsulation with certain polyurethane resins can cause both an overall color temperature shift and a shift toward green. If a linear luminaire 10 according to an embodiment of the invention is encapsulated, and if it carries RGB LED light engines that are capable of producing many different colors, the light output of the RGB LED light engines may be used to compensate for color and color temperature shifts caused by the encapsulation process. This will be described below in more detail.

Figure 5:
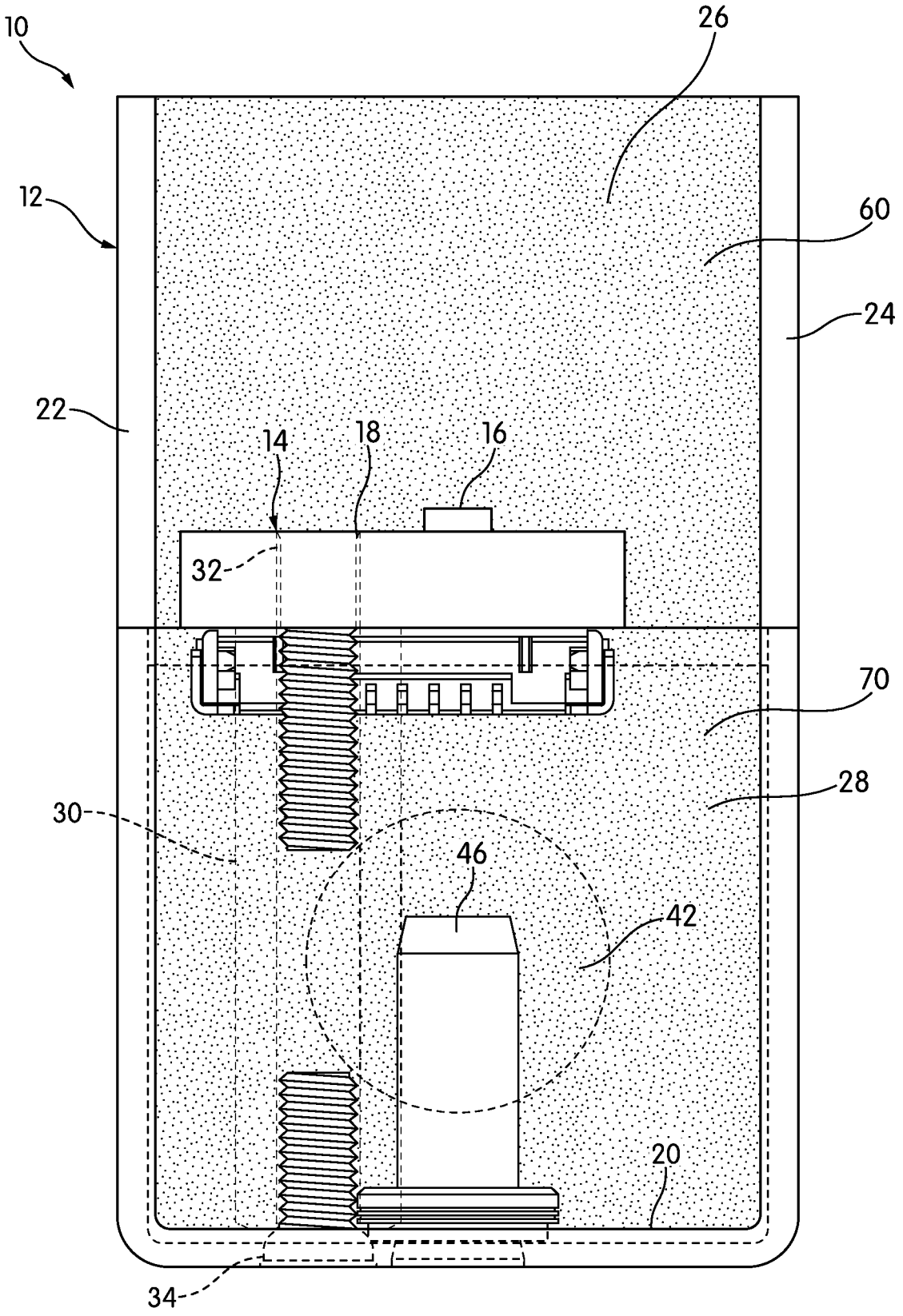
FIG. 5 is a view similar to the view of FIG. 2, illustrating the linear luminaire encapsulated with resin.

In any case, FIG. 5 is an end elevational view of the luminaire 10, similar to the view of FIG. 2, showing the luminaire 10 with a first potting material 60 in the upper compartment 26 and a second potting material 70 in the lower compartment 26. As explained in the Lopez-Martinez et al. patent and above, the two potting materials 60, 70 may be the same, or they may have the same base with different additives, thus adapting the second potting material 70 for heat transmission and the first potting material 60 for light transmission.

Lighting Circuits

As those of skill in the art will appreciate, LED light engines 16 are solid-state semiconductor devices that are powered and controlled by a microelectronic circuit. (In this description, the term "drive" will be used as a synonym for "power and control.") The exact type of circuit that is used to drive the LED light engines 16 will vary from embodiment to embodiment, depending on the nature of the LED light engines 16 (e.g., single-color or RGB) and the functions that the LED light engines 16 are to perform.

At its most basic, a drive circuit for LED light engines 16 of a single color may comprise a plurality of LED light engines 16 and a component or components to set the current in the circuit. The current-setting components may be either on the PCB 18 or in the power supply. The simplest current-setting component is a resistor, although current-source integrated circuits (ICs) may also be used. U.S. Pat. Nos. 10,928,017 and 10,897,802 provide more detail on basic LED lighting circuits and simple variations to those circuits that allow them to work with different input voltages and to provide different light outputs. Both of those patents are incorporated by reference herein in their entireties.

Many existing linear lighting circuits operate on direct current (DC) power at low voltage. For purposes of this description, the term "low voltage" refers to voltages under about 50V. However, there is no requirement that the voltage be low voltage. U.S. Pat. No. 10,028,345 gives examples of simple drive circuits for high-voltage linear lighting, and is incorporated by reference in its entirety.

If the LED light engines 16 are RGB LED light engines, drive circuits and systems can be more complex. First, RGB LED light engines typically have a separate circuit for each of the red LEDs, the green LEDs, and the blue LEDs. Second, red, green, and blue LEDs each have different forward voltages, which means that the configuration of, e.g., the red circuit may be different from the configuration of the blue circuit.

The elements described above are the elements that constitute a basic, functional lighting circuit. A basic lighting circuit will cause a luminaire to light when power is applied, but otherwise offers very little in the way of control or interface possibilities. With a basic lighting circuit, control elements external to a linear luminaire can be connected to it to allow more functionality. For example, external dimmers may allow a linear luminaire to dim. Additionally, if the linear luminaire has RGB LED light engines, it may be desirable to control the luminaire with an external controller that can translate a digital lighting control protocol, such as DMX512, into analog voltage signals for the LED light engines. The need for an external controller may also arise if a digital lighting control protocol like the digital addressable lighting interface (DALI).

Although complex lighting circuits are not necessarily the norm in the industry, since a strip of linear lighting 14 is a microelectronic circuit on a PCB 18, it is perfectly possible to place control elements on the PCB 18 with the LED light engines 16. Including control elements on the PCB 18 increases the functionality of the luminaire 10, reduces the number and type of external control modules that are required, and may improve the ability of the luminaire 10 to manage its own particular output issues, like color shifts caused by encapsulation.

Thus, in some embodiments, a linear luminare 10 may include the electronics necessary to decode digital control signals and drive the LED light engines 16 accordingly, or to perform any subset of those functions. Any lighting control methods or protocols may be implemented in hardware on the PCB, including DMX512, DALI, 0-10V dimming, etc. The following description provides an example of digital control circuitry for a linear luminaire 10 that, among other things, implements DMX512 to control a number of different types of LED light engines 16. Although the following description makes specific reference to the linear luminaire 10, the described drive circuitry may be implemented in other types of solid-state luminaires.

Figure 6:
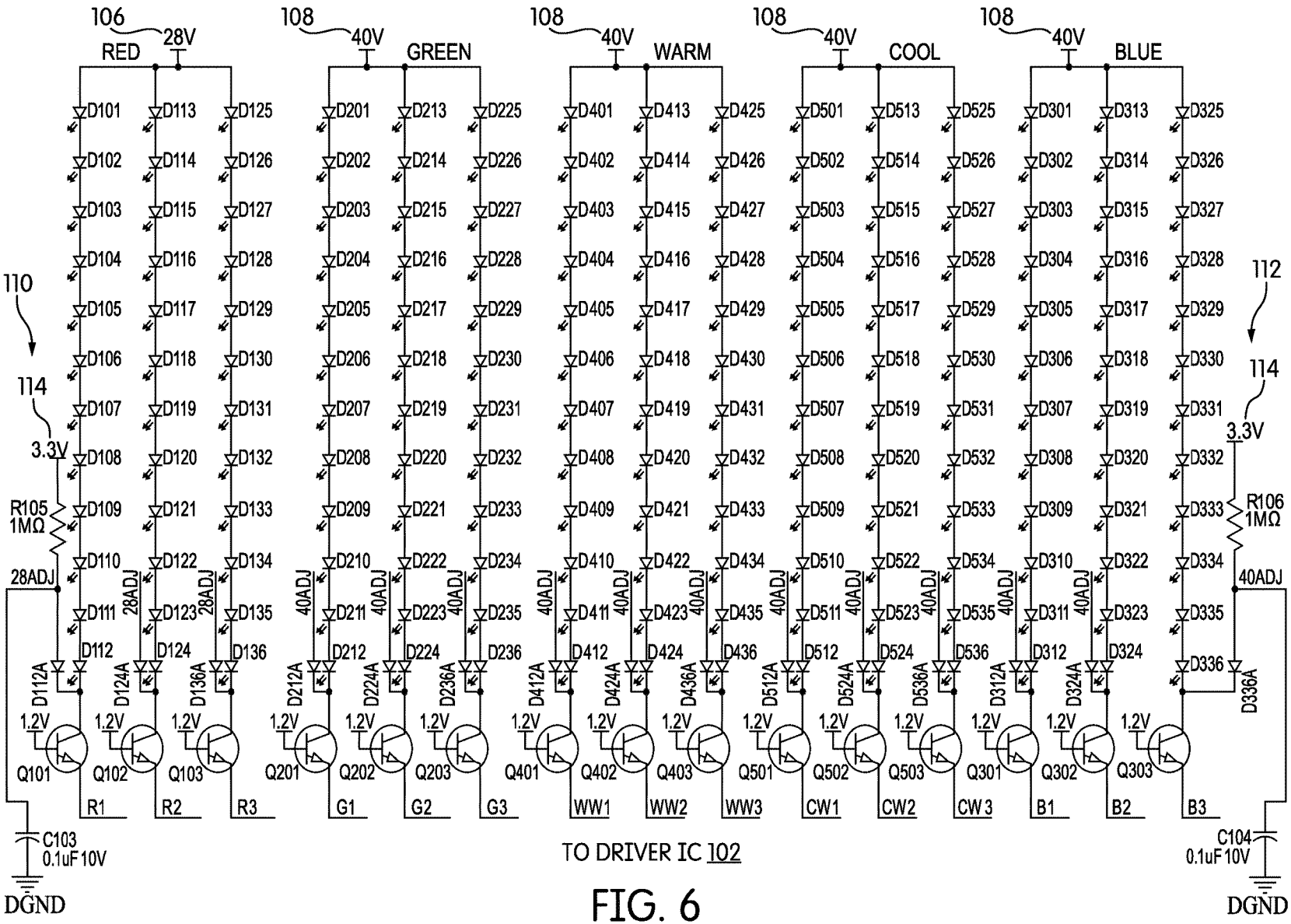
FIG. 6 is a schematic diagram of a first portion of a lighting circuit for a linear luminaire, illustrating series of different types of LED light engines.

FIG. 6 is a schematic diagram of a first portion of an LED drive circuit, generally indicated at 100, according to an embodiment of the invention. The LED drive circuit 100 illustrated in FIG. 6 assumes that the light engines 16 are actually of five different types: red LED light engines, green LED light engines, blue LED light engines, warm white LED light engines, and cool white LED light engines. As was described briefly above, the warm white LED light engines are blue-pump LED light engines topped by a phosphor that absorbs the blue light and emits a broader spectrum. The warm white LED light engines may have a color temperature of, e.g., 2700K, while the cool white LED light engines may have a color temperature of, e.g., 5000K.

The LED drive circuit 100 assumes that the linear luminaire 10 has 180 LED light engines per foot, 36 of each type. The LED light engines 16 are physically aligned with one another and spaced at a regular pitch along the PCB 18. Yet as shown in FIG. 6, electrically, the 36 LED light engines of each type are arranged as three parallel series of twelve LED light engines each: red R1, R2, R3; green G1, G2, G3; warm white WW1, WW2, WW3; cool white CW1, CW2, CW3; and blue B1, B2, B3.

At one end, each series of LED light engines R1 . . . B3 is connected to a voltage source 106, 108 that is adapted to forward bias the LED light engines in each series R1 . . . B3 to light. At the other end, each series of LED light engines R1 . . . B3 is connected to a driver integrated circuit (IC) 102. In this embodiment, the driver IC 102 is a TLC59116 16-channel constant-current LED driver (Texas Instruments, Dallas, Tex., United States). Thus, the driver IC 102 acts as the current-setting element in the circuit; the individual series R1 . . . B3 do not have any resistors or other current-setting elements. Additionally, the driver IC 102 is capable of controlling the output of each series of LED light engines R1 . . . B3 by applying a pulse-width modulation (PWM) current signal. The driver IC 102 of this embodiment has a maximum frequency in the low-megahertz range, and is capable of modulating the LED light engines in each series R1 . . . B3 at frequencies in the kilohertz range.

The TLC59116 has an 8-bit resolution for light output control, meaning that 256 individual light output levels are possible. Notably, this particular driver IC 102 requires a minimum applied voltage of about 0.3V in order to function. As will be described below in more detail, the driver IC 102 is under the control of a central unit 104 (not shown in FIG. 6), such as a microprocessor or microcontroller, that serves as an interface and decodes control signals in order to instruct the driver IC 102.

Because the circuit 100 contains several types of LED light engines, it has several voltage sources of different voltages. In particular, because the forward voltage of red LEDs is typically around 2V, the voltage source 106 that supplies the series of red LEDs R1, R2, R3 is a 28V source. The voltage source 108 that supplies the other series of LEDs G1 . . . B3 is a 40V source, because green and blue LEDs typically have higher forward voltages (the "white" light series WW1 . . . CW3 are blue-pump LED light engines with the same forward voltages as blue LEDs). The driver IC 102 sets the current in each series of LEDs to about 11 mA when the series of LED light engines R1 . . . B3 are on.

The difficulty with a circuit like this lies in the variation in forward voltages from one LED light engine 16 to the next. For example, the forward voltages of blue-light LEDs typically vary in the range of 3V-3.3V, with the precise forward voltage of any one LED light engine usually unknown to the designer. If one assumes the worst-case scenario—in this example, that the forward voltages are all 3.3V—that has the potential to waste power if, in fact, some of the LED light engines have lesser forward voltages. On the other hand, if one underestimates the required voltage, it may be difficult to bring all of the LED light engines 16 to full brightness.

The typical solution to this problem is to use a higher voltage and waste some power for the sake of bringing all of the LED light engines 16 to full brightness. However, there is another potential adverse impact of setting the voltage high enough to accommodate the worst-case forward voltage for every LED light engine 16: excess heat. In this circuit, any excess voltage is applied to the driver IC 102, and the transistors in the driver IC 102 generate heat in proportion to that applied voltage. The resultant heat can shorten the lifetimes of the LED light engines 16 as well as the components that drive them.

Thus, the LED drive circuit 100 is designed to adjust the applied voltage to the minimum value needed for a series of LEDs. There is also an additional mechanism to ensure that the driver IC is not exposed to transitory increases in voltage that may cause damage.

With respect to high voltage protection, a switching element is installed in each series of LED light engines R1 . . . B3. In this embodiment, at the bottom of each series of LED light engines R1 . . . B3, an NPN bipolar junction transistor (BJT) Q101, Q102, Q103 . . . Q503 is installed with its collector connected to one of the series of LED light engines R1 . . . B3 and its emitter connected to the driver IC 102. Each series of LED light engines R1 . . . B3 has its own BJT Q101 . . . Q503; thus, the BJTs Q101 . . . Q503 are interposed between the series of LED light engines R1 . . . B3 and the driver IC 102. The bases of the BJTs Q101 . . . Q503 are connected to a 1.2V DC source 105, which is enough voltage to exceed the base-emitter "on" voltage. Thus, when the series of LED light engines R1 . . . B3 are turned on by the driver IC 102, the BJTs Q101 . . . Q503 allow current to flow.

As those of skill in the art might observe, for the purpose of switching individual series of LED light engines R1 . . . B3 on and off, the BJTs Q101 . . . Q503 are redundant and unnecessary: the driver IC 102 handles that switching function itself.

However, the BJTs Q101 . . . Q503 may serve a useful function in protecting the driver IC 102 from high voltages that may cause damage, particularly in transitional and non-steady state situations. For example, in the instant after the driver IC 102 shuts down a series of LED light engines R1 . . . B3, the voltage approaches 28V in the series of red LED light engines R1, R2, R3, and the voltage approaches 40V in the other series of LED light engines G1 . . . B3. In other words, for an instant after a series of LED light engines R1 . . . B3 is shut down, the voltage approaches the full voltage of the voltage source 106, 108. If one considers that the driver IC 102 is driving the series of LED light engines R1 . . . B3 with a PWM current at a frequency that will often be in the kilohertz range, such non-steady state occurrences are frequent and become a greater concern.

A device like the driver IC 102 may only be able to take about 20V on a pin before the applied voltage could cause possible damage. The BJTs Q101 . . . Q503, which may be, e.g., MMBT3904 BJTs, may be able to take up to 60V without damage. The BJTs Q101 . . . Q503 are also able to switch off very quickly, in the range of a few tens of nanoseconds, once the voltage on the base is removed. Thus, the BJTs Q101 . . . Q503 serve to protect the driver IC 102 from transitory increases in voltage.

The BJTs Q101 . . . Q503 are one example of a switching device that could be used to perform this protective function. In other embodiments, other kinds of switching devices could be used. For example, a field-effect transistor (FET) may be used in some embodiments. In that case, the 1.2V source would be adjusted as appropriate.

As was described above, the drive circuit 100 also preferably includes a mechanism to adjust the applied voltages in order to compensate for variations in LED forward voltage without wasting power and generating excess heat. The first part of that mechanism involves sensing how much voltage remains at the bottom of a series of LED light engines R1 . . . B3, i.e., the total voltage drop in that series.

To that end, each series of LED light engines R1 . . . B3 has a parallel leg 110, 112 connected to the series R1 . . . B3 just below the cathode of the last LED light engine D112 . . . D336 in the series R1 . . . B3. The parallel legs 110, 112 join the series R1 . . . B3 just above the collectors of the BJTs Q101 . . . Q503. Although each series has such a parallel leg 110, 112 to simplify the diagram of the drive circuit 100 of FIG. 6, the full parallel leg 110, 112 is shown only on series R1 and series B3.

Each parallel leg 110, 112 contains an RC low-pass filter. More specifically, each parallel leg 110, 112 includes a large, 0.1 μF capacitor C103, C104 connected to a 1 MΩ, resistor R105, R106. A small voltage source 114, in this embodiment, 3.3V, charges the capacitor C103, C104. The resistor R105, R106 and the capacitor C103, C104 form an RC circuit. In this case, the time constant of that circuit is approximately 0.1 s, sufficient to filter out a kilohertz-range PWM modulation. A diode D112A, D336A with a small forward voltage (e.g., in the range of 0.6-0.7V) is arranged in parallel with the last LED D112, D136 in the series, with its cathode connected below the cathode of the last LED D112, D136 in the series. As was described above, under non-steady state conditions, voltage can build up at the collector of the BJT Q101 . . . Q503. The diode D112, D136 in the parallel leg 110, 112 prevents any large, transient voltages from charging the capacitor C103, C104, allowing the parallel leg 110, 112 and its low-pass RC filter to function as expected. The low-pass filtered voltages in the parallel legs 110, 112, which correspond to the steady-state voltages that remain after the last LED D112, D136 in the series R1 . . . B3, are indicated as 28ADJ and 40ADJ, respectively, in FIG. 6.

The 28ADJ and 40ADJ voltages drawn from the parallel legs 110, 112 at the bottoms of the series of LED light engines R1 . . . B3 are sent into feedback circuits, described in more detail below, that either raise the voltage applied to the series of LED light engines R1 . . . B3 or decrease that voltage. For the sake of simplicity in design, the applied voltage is not adjusted for each individual series of LED light engines R1 . . . B3. Instead, whichever 28V series R1 . . . R3 has the lowest voltage controls whether the 28V source is increased or decreased in voltage, and whichever 40V series G1 . . . B3 has the lowest voltage controls whether the 40V source is increased or decreased in voltage. In some embodiments, the voltages to the series of LED light engines R1 . . . B3 may be individually controlled.

Figure 7:
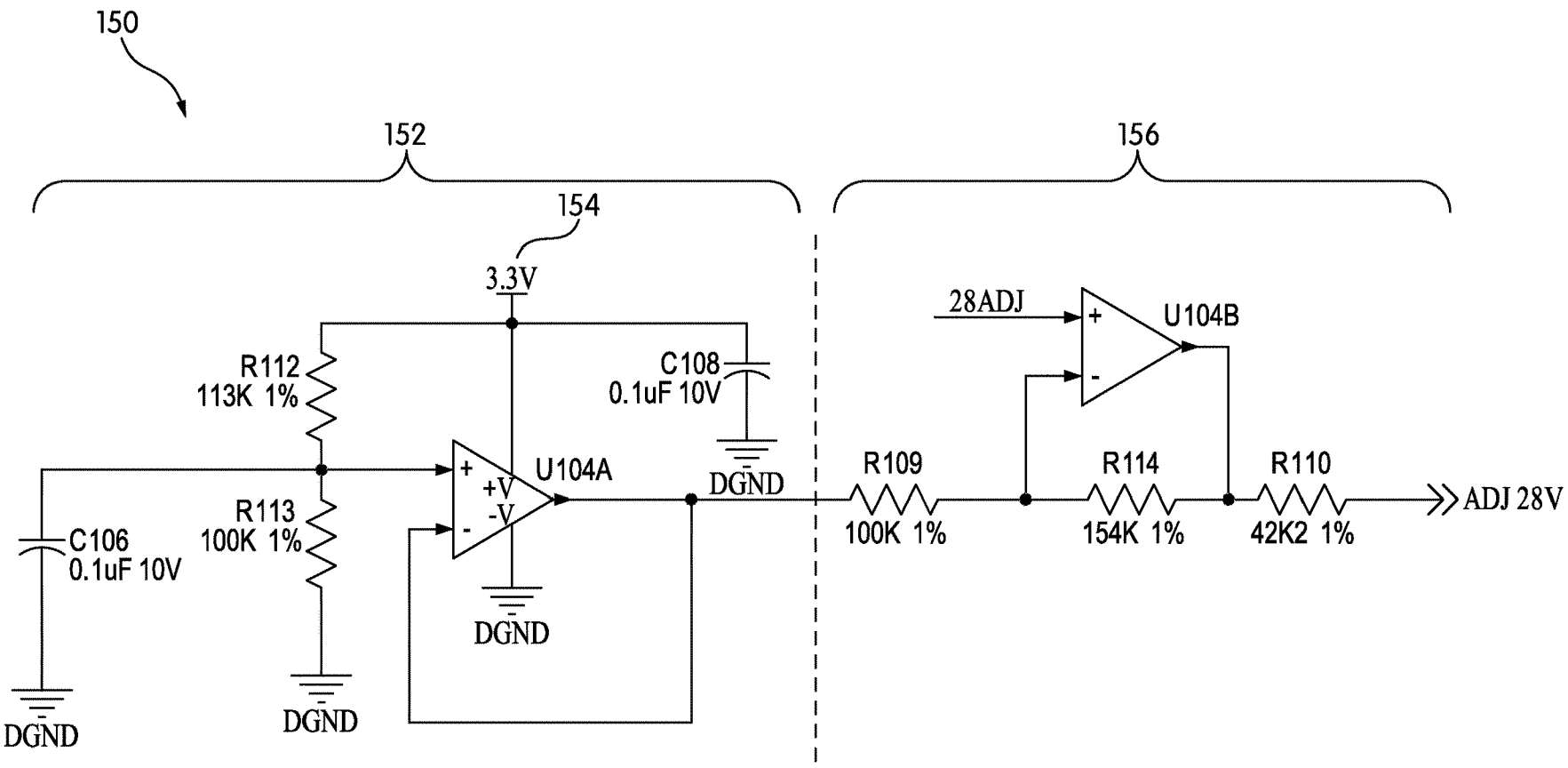
FIG. 7 is a schematic diagram of a first voltage feedback circuit for voltage adjustment in a linear luminaire.

FIG. 7 is a schematic diagram of the first portion of a feedback control circuit, generally indicated at 150. The left side of the circuit, generally indicated at 152, is a buffered voltage source that takes a voltage source 154, in this embodiment, a 3.3V source, and uses an op amp U104A in a voltage-follower configuration to produce a buffered voltage output.

More specifically, the voltage from the voltage source 154 goes to a voltage divider comprised of two resistors R112, R113. The output from the voltage divider is sent to the noninverting input of the op amp U104A; the inverting input of the op amp U104A is connected to the output, such that the op amp U104A is in a voltage follower configuration. Thus, the voltage output of the left side of the circuit 152 is entirely dependent on the voltage supplied by the voltage source 154 and on the values of the resistors R112, R113 that comprise a voltage divider. In this embodiment, that output voltage is designed to be 1.549V. Capacitors C106, C108 are placed on each leg of the circuit that connects with the noninverting input of the op amp U104A to filter noise. The op amp U104A itself is connected to the 3.3V source 154 and to ground.

The advantage of the buffered voltage source 154 is that it is simple and requires relatively few components; however, any topology that produces a stable voltage may be used.

The second side 156 of the feedback control circuit 150 is connected to the first side 152 of the circuit 150 and includes a second op amp U104B. The second op amp U104B has a gain determined by the ratio of the values of two resistors, resistor R109 and resistor R114. The inverting input of the second op amp U104B connects between the two resistors R109, R114, with resistor R114 connected between the inverting input and the output of the second op amp U104B and resistor R109 connected in series with the output of the first side 152 of the circuit 150.

The noninverting input of the second op amp U104B receives the voltage 28ADJ drawn from the parallel leg 110. In the illustrated embodiment, resistor R114 is a 154 k) resistor and resistor R109 is a 100 k) resistor. If the voltage 28ADJ that is received by the noninverting input of the second op amp U104B is zero, the second op amp U104B acts as a traditional inverting amplifier with a gain equal to Expression 1:

$$-V_{fs}\left(\frac{R114}{R109}\right) \tag{1}$$

where $V_{fs}$ is the voltage from the first side 152, and R109 and R114 are the values in Ohms of those resistors.

When the voltage on the noninverting input of the second op amp U104B is nonzero, with the arrangement shown, that voltage has a gain equal to Expression 2:

$$28ADJ\left(1+\frac{R114}{R109}\right) \tag{2}$$

where 28ADJ is the voltage drawn from the parallel leg 110 and received by the noninverting input of the second op amp U104B, as described above. Thus, the output voltage ADJ28V of the second side 156 of the circuit 150, i.e., the output of the circuit 150 is given by Equation 1:

$$ADJ28V = 28ADJ\left(1+\frac{R114}{R109}\right) - V_{fs}\left(\frac{R114}{R109}\right) \qquad \text{Eq. (1)}$$

In Equation 1 above, ADJ28V is the feedback voltage that is supplied to the circuit controlling the 28V source 106. That circuit will be described below in more detail. An additional resistor R107 is at the output of the second op amp U103B.

Figure 8:
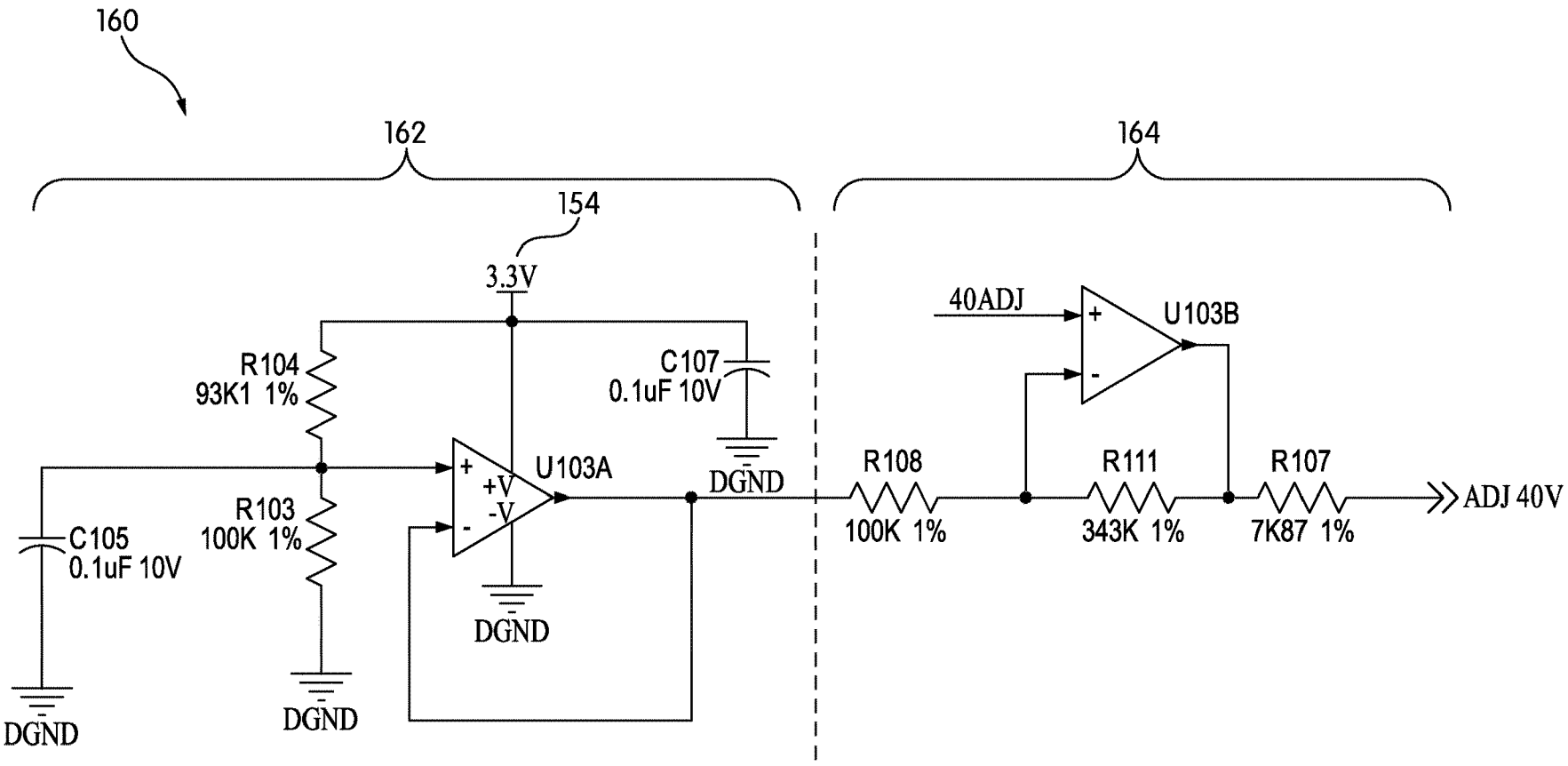
FIG. 8 is a schematic diagram of a second voltage feedback circuit for voltage adjustment in a linear luminaire.

FIG. 8 is a schematic diagram of the corresponding feedback circuit 160 for the 40V voltage sources. The feedback circuit 160 of FIG. 8 is identical in overall topology to the feedback circuit 150 of FIG. 7. The differences lie in the values of the resistors and other components.

Specifically, the feedback circuit 160 has a first side 160 that produces a buffered voltage output. A voltage divider comprised of resistors R103 and R104 takes a 3.3V voltage source 154 and directs its output to the non-inverting input of a first op amp U103A. The voltage source 154 also powers the first op amp U103A itself. The first op amp U103A is configured as a voltage follower, with the inverting input of the first op amp U103A connected to the output. The values of the voltage-divider resistors R103, R104 are selected such that, in this case, the output of the first side 162 of the circuit is a buffered 1.7V. Capacitors C105, C107 are placed on the legs of the first side 160 circuit that feed into the non-inverting input of the first op amp U103A to filter noise.

The second side 164 of the feedback circuit 160 of FIG. 8 is configured essentially identically to the second side 156 of the circuit 150 of FIG. 7, with a second op amp U103B. In this case, the output of the second side, ADJ40V, is given in Equation (2):

$$ADJ40V = 40ADJ\left(1 + \frac{R111}{R108}\right) - V_{fs}\left(\frac{R111}{R108}\right) \quad \text{Eq. (2)}$$

Where 40ADJ is the voltage drawn from the parallel legs 112 of the 40V series of LED light engines G1 . . . B3, ADJ40 is the output of the feedback circuit 160, and R108 and R111 are the resistance values of those resistors.

In the illustrated embodiment, resistor R108 is a 100 kΩ resistor and R111 is a 343 kΩ resistor. All of the op amps U103A, U103B, U104A, U104B in both feedback circuits 150, 160 are TSZ122IQ2T op amps (STMicroelectronics, Geneva, Switzerland).

Other voltage sources in the lighting circuit 100 may have the same buffered voltage-follower topology as the first sides 152, 162 of the feedback circuits 150, 160. For example, the 1.2V source 105 that is applied to the base of the BJTs Q101 . . . Q503 may have this topology.

Figures 1, 9:
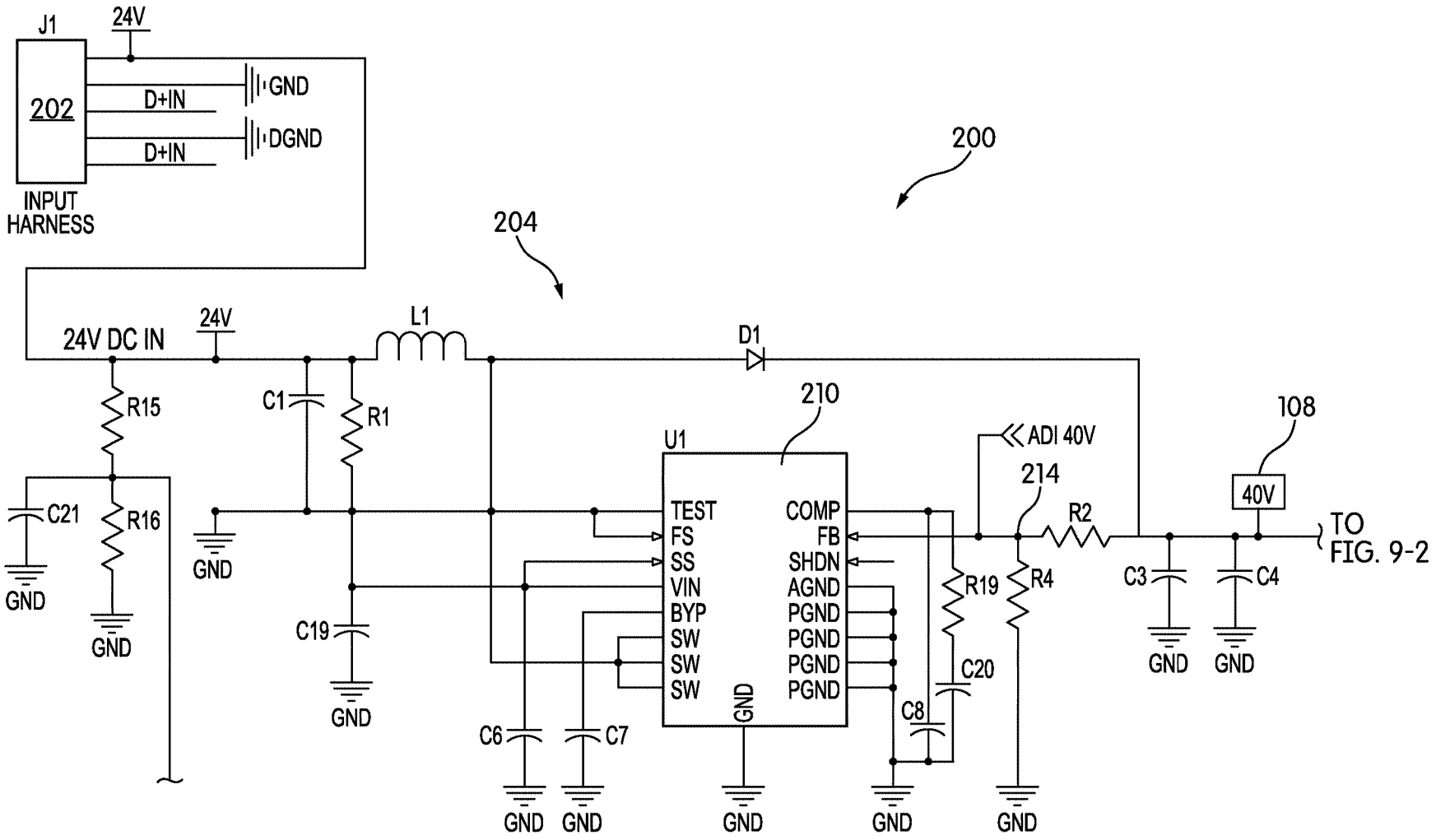
Figures 2, 9:
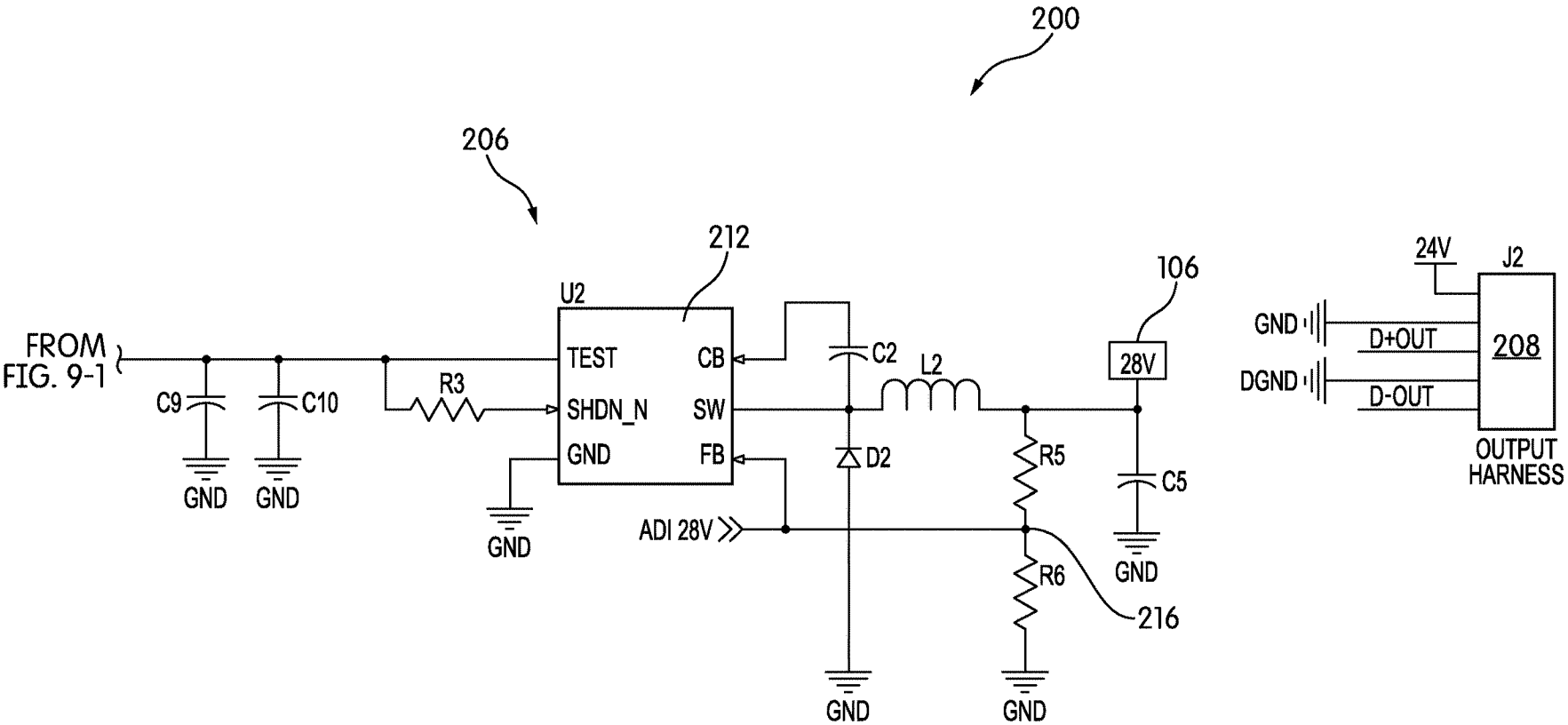

In order to understand how the feedback voltages ADJ28V, ADJ40V output from the circuits of FIGS. 7-8 are used, it is helpful to look at the power circuitry for the lighting circuit 100. FIGS. 9-1 and 9-2 are, collectively, a schematic circuit diagram of the power circuitry 200 of the lighting circuit 100. The power circuitry 200 is designed to receive 24V DC from an input harness 202. The precise characteristics of the power circuitry 200 are not critical to an understanding of the invention. For these purposes, it is sufficient to say that from the input harness 202, power flows into a boost converter 204, i.e., a step-up converter, that produces the 40V voltage source 108. From the boost converter 204, 40 VDC is sent to a buck converter 206, i.e., a step-down converter, that produces the 28V voltage source 106. An output harness 208 receives 24 VDC so that the linear luminaires 10 can be "daisy chained" with one luminaire 10 supplying power for the next.

The boost converter 204 is controlled by a high voltage switch-mode regulator integrated circuit 210, such as the LM5000SD-3/NOPB (Texas Instruments, Dallas, Tex., United States). The buck converter 206 is controlled by a buck regulator integrated circuit 212, such as the LMR16006 (Texas Instruments, Dallas, Tex., United States). Both of these integrated circuits 210, 212 have feedback pins FB to regulate the output voltage.

The feedback voltage for each of the regulator ICs 210, 212 is set by a voltage divider network. In the illustrated embodiment, the boost regulator IC 210 has a voltage divider 214 comprised of resistors R2 and R4, which in this case are a 324 kΩ resistor and a 10 kΩ, resistor, respectively. The buck regulator IC 212 has a voltage divider 216 comprised of resistors R5 and R6, which in this case are a 2871*d*) resistor and a 10 kΩ resistor, respectively.

The voltage output ADJ40 from the feedback circuit 160 is received at a terminal between the voltage divider 214 and the feedback pin FB of the boost IC 210. Similarly, the voltage output ADJ28V from the feedback circuit 150 is received at a terminal between the voltage divider 216 and the feedback pin FB of the buck IC 212. With this layout, if the feedback voltages ADJ28V, ADJ40V are positive, they add to the voltage seen by the feedback pins FB of the boost and buck ICs 210, 212. If the feedback voltages ADJ28V, ADJ40V are negative, they subtract from the voltage seen by the feedback pins of the boost and buck ICs 210, 212. The total voltages seen by the respective feedback pins FB of the boost and buck ICs 210, 212 determine whether the voltages of the voltage sources 106, 108 are upregulated or downregulated.

The voltage setpoints that cause the voltage of the voltage sources 106, 108 to be upregulated or downregulated depend on the particular characteristics of the lighting circuit 100. In this embodiment, because of the minimum-voltage requirements of the driver IC 102, the basic assumption is that the voltage at the bottoms of the series of LED light engines R1 . . . B3 should not fall below 0.5V. The feedback circuits 150, 160 are configured to produce output voltages ADJ28V, ADJ40V in accordance with that goal.

Figure 10:
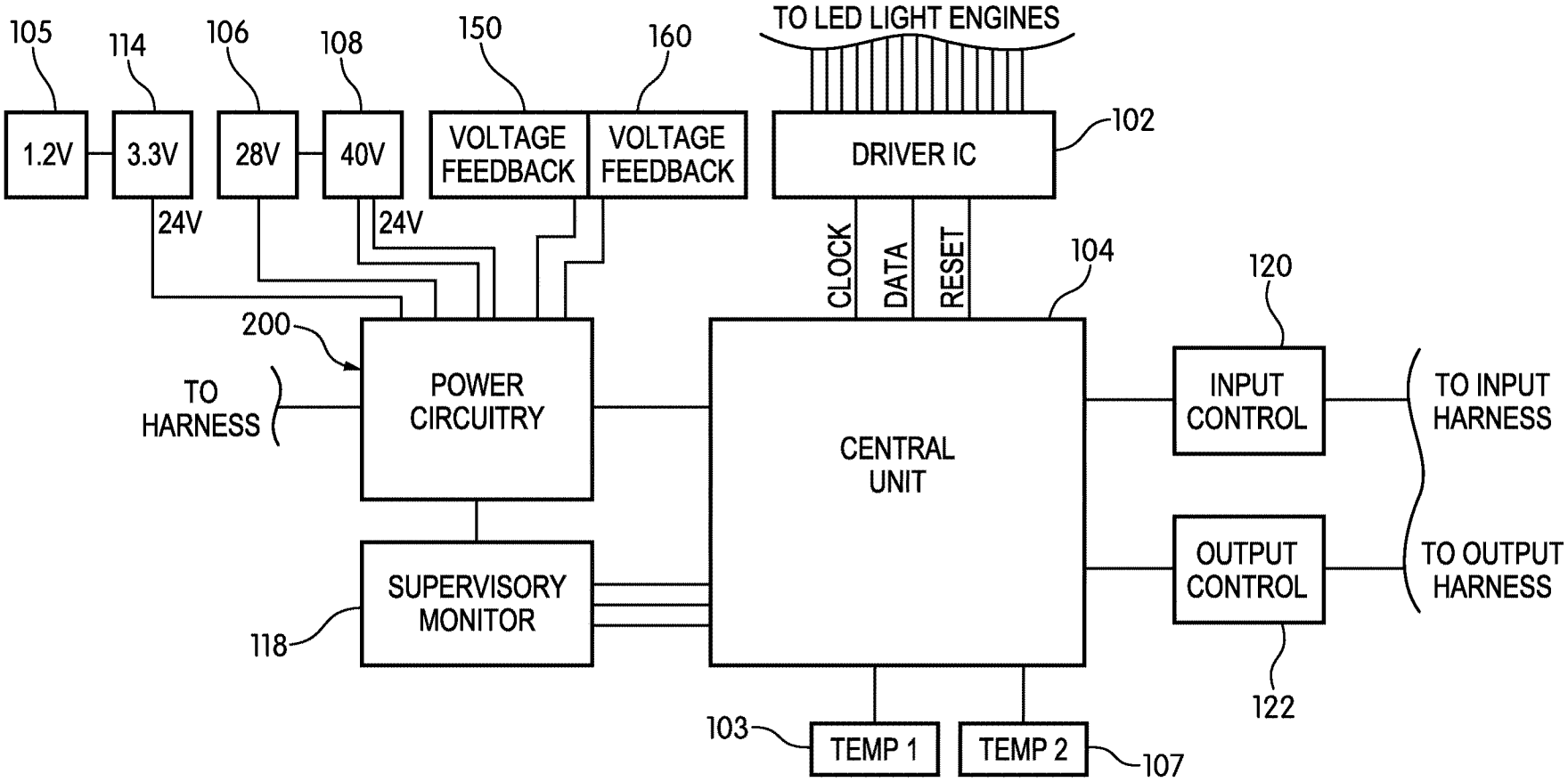
FIG. 10 is a schematic overall diagram of a lighting circuit for a linear luminaire.

FIG. 10 is a schematic diagram of the LED drive circuit 100 in its entirety. The driver IC 102 that drives the series of LED light engines R1 . . . B3 is connected to the central unit 104. The central unit 104 in this case is a microprocessor, namely an MSP430FR2153TRSMR (Texas Instruments, Dallas, Tex., United States). Typically, the central unit 104 provides clock, data, and reset signals to the driver IC 102. The central unit 104 itself is monitored by a supervisor/monitor IC 118, such as a TPS3851E (Texas Instruments, Dallas, Tex., United States), which has the ability to reset the central unit 104 when needed. The central unit 102 receives input through an input controller 120 and an output controller 122, which are bus line transceiver ICs.

As was described previously, the power circuitry 200 provides separate voltage sources 105, 106, 108, 114 of various voltages using boost and buck converters 204, 206. While not described in detail above, the 3.3V source may be provided by a single, integrated power step down module that receives 24 VDC and outputs the 3.3V, such as a LMZM23600V3SILR (Texas Instruments, Dallas, Tex., United States), or by the kind of custom voltage division and regulation/buffering circuit described above. The power circuitry receives feedback from the two feedback circuits 150, 160 as was also described above.

The lighting circuit 100 described above has a number of advantages. First among them is more efficient use of power. There are other advantages as well. For example, one conventional way to resolve the problem of LED light engines with varying forward voltages is to buy LED light engines that have been tested and confirmed to have the same forward voltage to within a particular tolerance. However, LED light engines that have been specified or confirmed to have the same forward voltage are more expensive. The lighting circuit 100 described above may allow an LED luminaire 10 to use less expensive LED light engines 16, because LED light engines 16 of the same type need not have the same forward voltages; instead, the lighting circuit 100 can compensate for variations.

It may be possible to derive additional power savings and additional benefits in some embodiments. More specifically, the feedback control circuits 150, 160 described above produce a single voltage output, ADJ28V or ADJ40V, to upregulate or downregulate the voltage applied to the series of LED light engines R1 . . . B3 for each voltage input. With these feedback control circuits 150, 160, it is possible that there may be some error in the ADJ28V or ADJ40V output. For example, the ADJ28V or ADJ40V output voltage may overshoot or undershoot the voltage required for the circuitry to provide the exact voltage necessary to power the series of LED light engines R1 . . . B3 in any given instant. This may be especially true if the necessary voltage changes rapidly, which it may, depending on how the series of LED light engines R1 . . . B3 is driven.

Figure 13:
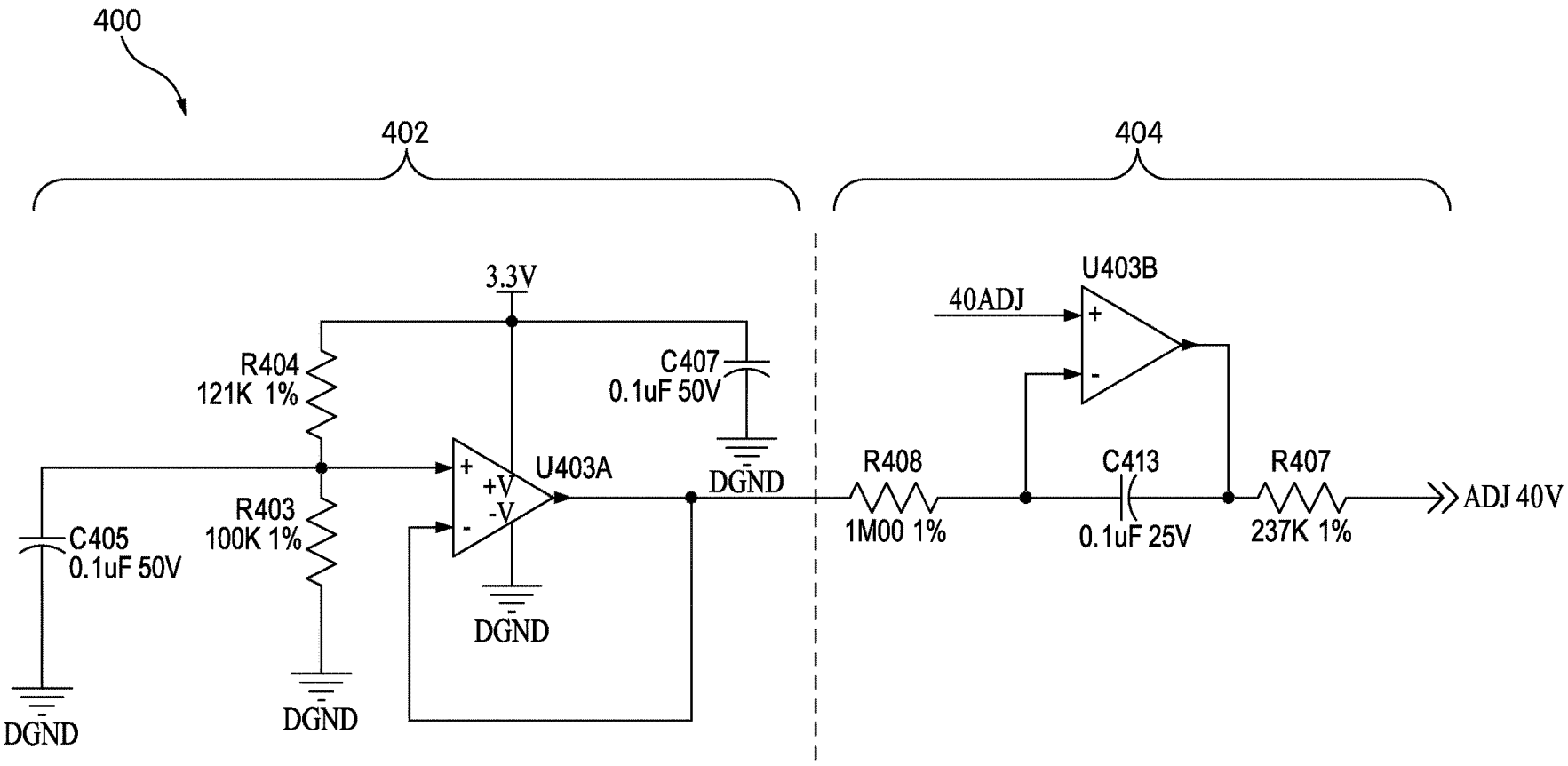
FIG. 13 is a schematic diagram of a first alternative voltage feedback circuit for voltage adjustment in a linear luminaire.

FIG. 13 illustrates an alternative feedback control circuit 400 that takes as input the remainder voltage 40ADJ described above and outputs a feedback control voltage ADJ40V that is applied to the feedback pin FB of the regulator 210 in the boost converter 204.

The feedback control circuit 400 has a very similar topology to the feedback control circuit 160 of FIG. 8, including a first side 402 that produces a buffered voltage output using an op amp U403A in a voltage follower configuration, and a second side 404, connected to the first side, that receives the remainder voltage 40ADJ at the non-inverting input of a second op amp U403B. The main difference between the feedback control circuit 400 and the feedback control circuit 160 described above is that in the feedback control circuit 400, the second op amp U403B is configured as an op amp integrator. Specifically, an RC network is connected across the op amp's feedback path, with a 1 MΩ, resistor R408 in the path to the op amp U403B inverting input, and a 0.1 μF capacitor C413 connected between the non-inverting input and the output.

As was described above, the goal is to provide enough voltage to power the LEDs in each series R1 . . . B3 while leaving sufficient remaining voltage on the driver IC 102 to allow it to function. The minimum voltage allowable on the driver IC 102 may be a small voltage like 0.3V, as described above, but for design purposes, it is better to keep the voltage above the design minimum of the driver IC 102. For that reason, the voltage at the emitter of the BJTs Q101 . . . Q503, which is the voltage applied to the driver IC 102, is preferably at least about 0.5V in this embodiment. If the emitter voltage of any one of the BJTs Q101 . . . Q503 is 0.5V, its collector voltage is most likely at 1V, and the 40ADJ voltage drawn from the parallel leg 110, 112 is likely 1.5V.

For this reason, the first side 402 of the feedback control circuit 400 provides a buffered voltage output of about 1.5V using the op amp U403A configured as a voltage follower. That buffered 1.5V is input to the inverting input of the op amp U403B through the 1 MΩ, resistor R408. The 40ADJ voltage is input to the non-inverting input of the op amp U403B. Any difference between the buffered 1.5V input to the inverting input of the op amp U403B and the 40ADJ voltage applied to the non-inverting input of the op amp U403B results in a ramped positive or negative voltage output for ADJ40V that continues to increase or decrease until the voltage applied to the feedback pin FB of the regulator IC 210 causes 40ADJ to return to 1.5V. The regulator IC 210 itself and the voltage divider network around it is designed such that the feedback pin FB of the regulator IC 210 sees a reference voltage of 1.259V when no changes are necessary to the voltage output; as described above, the ADJ40V output changes the voltage seen by the feedback pin FB of the regulator IC 210.

The continuously increasing or decreasing ramp created by the op amp integrator U403B, C413, R408 in the second side 404 of the feedback circuit 400 tends to zero any error that occurs, causing the circuit to follow more closely any changes to the voltage 40ADJ found in the parallel legs 112.

Figure 14:
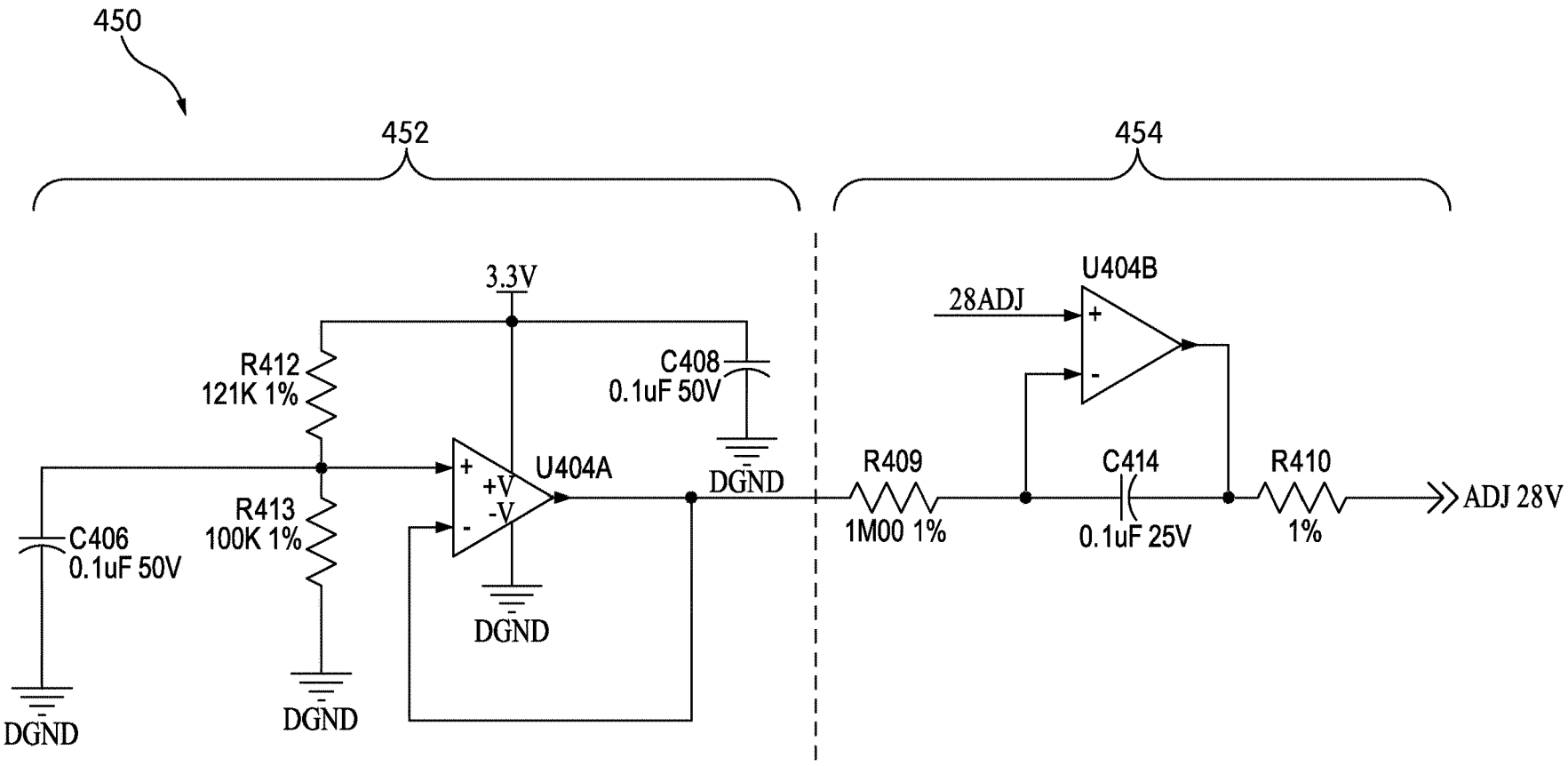
FIG. 14 is a schematic diagram of a second alternative voltage feedback circuit for voltage adjustment in a linear luminaire.

FIG. 14 is a circuit diagram of the corresponding 28V feedback control circuit 450 for the red series of LED light engines R1, R2, R3. The feedback control circuit 450 is essentially identical to the feedback control circuit 400 described above, with a first side 452 that produces a buffered voltage output of 1.5V using an op amp U404A in a voltage follower configuration, and a second side 454 that takes the 28ADJ voltage and produces a ramped output voltage ADJ28V using an op amp U404B in an integrator configuration with a 0.1 μF capacitor C414 between the inverting input and the output of the op amp U404B and a 1 MΩ resistor R409 in the path to the inverting input.

The rate of rise or fall of the voltage output, which is determined in part by the RC time constants of the resistor-capacitor networks (R408 and C413; R409 and C414), is not critical, so long as it is slow enough so as not to cause any instability.

Software Control

Because the central unit 104 is a programmable component, a number of useful control methods for a linear luminaire 10 can be implemented either entirely in software, or in a combination of hardware and software. "Software," for purposes of these instructions, refers to a set of machine-readable instructions that, when executed by a machine like the central unit 104, cause the machine to perform certain tasks. Software is typically embodied or stored in some form of non-transitory machine-readable medium. As was noted above with respect to circuitry, although portions of the following description make reference to the linear luminaire 10 and its central unit 104, these methods, and the software that embodies these methods, may be implemented on other types of luminaires using other types of hardware.

With the linear luminaire 10, the machine-readable medium will typically be firmware or onboard memory programmed at the time of manufacture. However, if needed, a linear luminaire 10 could have other types of machine-readable media, like flash memory, a solid-state drive, or the like. Software and related commands may be communicated via the input controller 120 and the output controller 122 and sent through the input and output harnesses 202, 208. In some cases, the lighting circuit 100 may have an interface such as a universal serial bus (USB) interface, with an appropriate port, to allow for upload of firmware updates and other forms of software installation. If the lighting circuit 100 has a USB interface, a USB drive may serve as a non-transitory machine-readable medium to transfer software from, e.g., a development computer to the linear luminaire 10. In yet other embodiments, the lighting circuit 100 may include a wireless interface to allow for communication and programming functions.

As was described in detail above, one concern for linear luminaires 10 is power usage. In the design of an installation that uses linear luminaires 10, it is assumed that there is some power budget that should not be exceeded, either because of limitations on the power supplies that supply the input power to the linear luminaires 10, because of safety regulations, or because of a general desire to conserve power. For example, a linear luminaire 10 may have a power budget of 6 W per foot. In the illustrated embodiment, that power must be divided among the various series of LED light engines R1 . . . B3. In keeping with this power budget, the driver IC typically sets the current in each series of LED light engines R1 . . . B3 to 11 mA.

As important as power budgeting and power conservation may be, brightness is also relevant. "Brightness," as the term is used in this description, refers to the human perception of radiant or reflected light. Brightness is related to the luminous flux (i.e., the light output) of a light source, but it is not entirely dependent on it. For example, the Helmholtz-Kohlrausch effect is a perceptual phenomenon in which intensely saturated colors are seen by the human eye as brighter than "white" light of equal luminous flux. Simply put, a linear luminaire 10 may not be adequate for its task if it is not bright enough to be seen in its environment.

Figure 11:
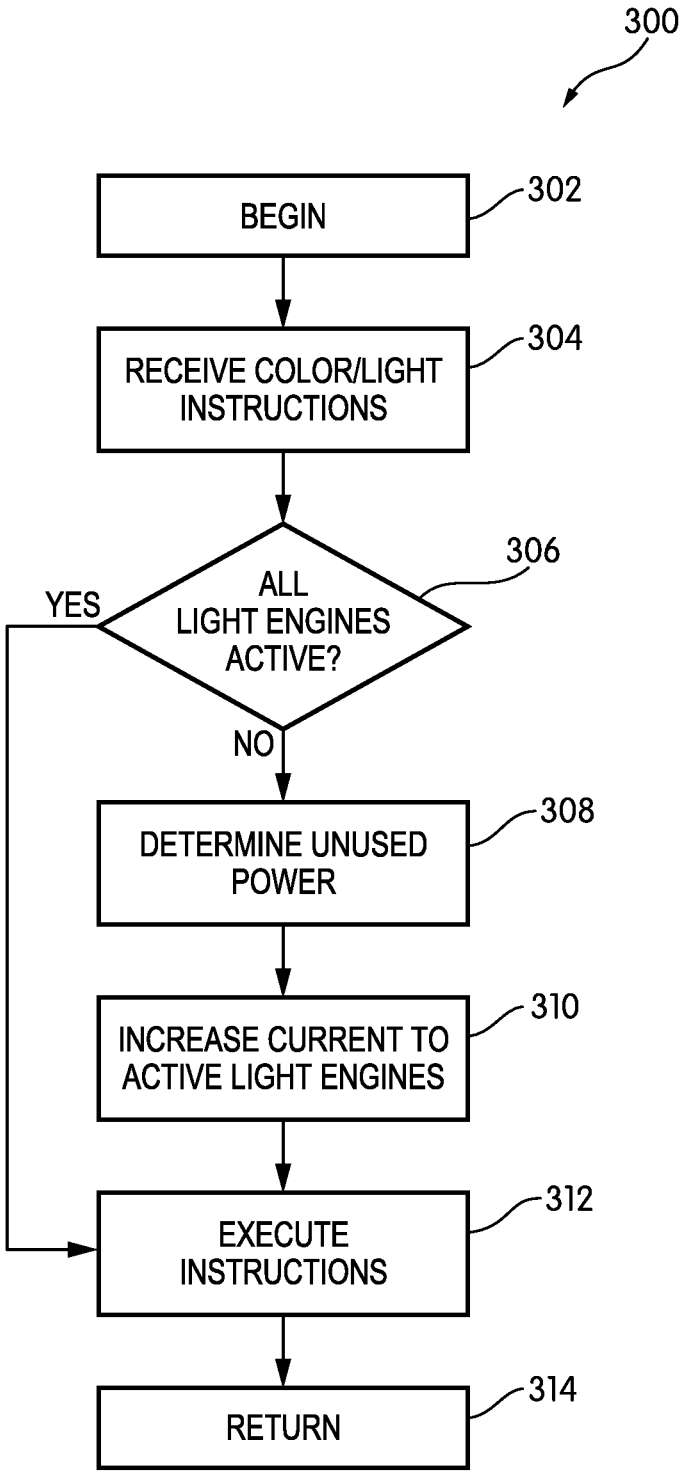
FIG. 11 is a schematic diagram of a method for allocating power among series of LED light engines in a linear luminaire.
Figure 12:
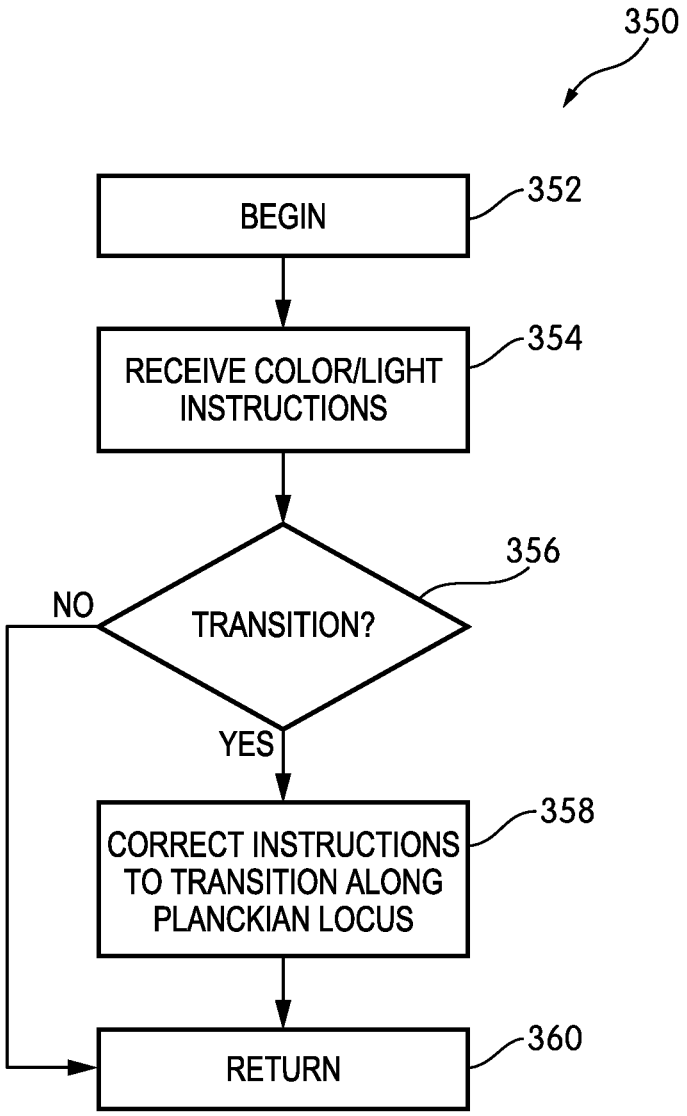
FIG. 12 is a schematic diagram of a method for color-correcting transitions between one color temperature of white light and another.

To that end, FIG. 11 illustrates a method, generally indicated at 300, for budgeting and shifting power among the series of LED light engines R1 . . . B3 installed in a linear luminaire 10. The following description of method 300 assumes that the linear luminaire in question is the linear luminaire 10 with the series of LED light engines R1 . . . B3 described above, although method 300 is applicable to any linear luminaire that uses multiple sets of LED light engines 16. Method 300 begins at task 302 and continues with task 304.

In task 304, the central unit 104 receives instructions to activate one or more series of LED light engines R1 . . . B3. These instructions may be in any format and using any protocol. For example, the instructions in question could be instructions in the DMX512 protocol, or they could be simple 0-10V signals indicating brightness. Method 300 continues with task 306.

Task 306 is a decision task. In task 306, the central unit 104 parses the instructions received in task 304 to determine which of the series of LED light engines R1 . . . B3 will be active when executing the instructions. If all of the series of LED light engines R1 . . . B3 will be active when executing the instructions (task 306:YES), method 300 continues with task 312, and the instructions are executed. (The central unit 104 may alter or offset the instructions before executing them, as will be explained below in more detail.)

If all of the series of LED light engines R1 . . . B3 will not be active when executing the instructions (task 306:NO), method 300 continues with task 308. In this case, with some of the series of LED light engines R1 . . . B3 off, there is some amount of unbudgeted power. In task 308, the central unit 104 calculates how much of the power budget will be unspent if the instructions are executed. For example, if the red series of LED light engines R1, R2, R3 are unused, there may be nearly a watt of unused power. In calculating the power that will be unspent, the central unit 104 may use the ideal voltage that is intended to be used (e.g., 28V, 40V), or the central unit 104 may use the actual applied voltage generated by the feedback circuits 150, 160 to compensate for forward voltage variations.

Once the central unit 104 has calculated the unused power in task 308, method 300 continues with task 310. In task 310, the central unit 104 distributes the unused power among the series of LED light engines R1 . . . B3 that will be used when the instructions are executed. This would typically be done by instructing the driver IC 102 to increase the current level in each of the series R1 . . . B3 that will be active when the instructions are executed. This, in turn, would typically be done by increasing the duty cycle of the series R1 . . . B3. This is possible because the individual LED light engines 16 will typically be rated for more current than is applied when all of the series of LED light engines R1 . . . B3 are active. For example, individual LED light engines 16 may be rated for a current of 30 mA or more.

In some implementations of task 310, the unused power may be evenly divided among the active series of LED light engines R1 . . . B3. However, that need not always be the case. Instead, in some implementations, task 310 may put more of the unused power into the "white" light series of LED light engines WW1, WW2, WW3, CW1, CW2, CW3 in view of the Helmholtz-Kohlrausch effect. Other perceptual phenomena involving brightness may also be taken into account in allocating unused power. To the extent possible, however, any power increases should across-the-board, applied to all active series. Increasing the power to or duty cycle of only one series R1 . . . B3 relative to the others may cause color shifts relative to the color that was intended or commanded.

In task 312, the instructions are executed and the series of LED light engines R1 . . . B3 are activated as instructed. If control of method 300 passed directly from task 306 to task 312, this would be done without power adjustments. If control of method 300 passed from task 310 to 312, the instructions are executed with unused power distributed among the active series of LED light engines R1 . . . B3.

Method 300 terminates and returns at task 314. Generally speaking, if method 300 is implemented, it would be executed every time a new instruction or set of instructions is received. As those of skill in the art may realize, although power utilization and allocation determinations (tasks 308 and 310) are followed immediately by execution of instructions (task 312) in the description above, in some embodiments, the central unit 104 may pre-process instructions and determine power allocations for later execution.

As those of skill in the art will note, method 300 is a method for power control that refers to a set power budget. In some cases, simpler methods may be used. For example, in some embodiments, it may be sufficient to set every series of LED light engines R1 . . . B3 to a particular current setpoint, except when all of the series of LED light engines R1 . . . B3 are active, in which case a lower current setpoint is enforced. For example, each series of LED light engines R1 . . . B3 could be set to 120% of nominal current, unless all of the series R1 . . . B3 are active, in which case the lower, 100% nominal current level is set and enforced for each series. Such setpoint-based methods may be simpler to use.

In the context of the luminaire 10, enforcing a current limit may mean limiting each series of LED light engines R1 . . . B3 to a particular maximum duty cycle that is less than 100%. For example, if the driver IC 102 permits an 8-bit resolution for duty cycle, allowing 256 possible duty cycles for each series of LED light engines R1 . . . B3 where 0 represents 0% duty cycle and 255 represents 100% duty cycle, the series of LED light engines R1 . . . B3 in a group may be limited to a duty cycle of, e.g., 204. If the commanded duty cycle for any of the series of LED light engines R1 . . . B3 exceeds that defined threshold, a scaling fraction (90% of commanded duty cycle, 80%, etc.) is applied to each of the series of LED light engines R1 . . . B3 until all series R1 . . . B3 are back below the threshold. By scaling back all series of LED light engines R1 . . . B3 together, the luminaire 10 can achieve a power budget target without creating a color shift that would otherwise occur if only one or two series R1 . . . B3 were scaled back.

Figure 15:
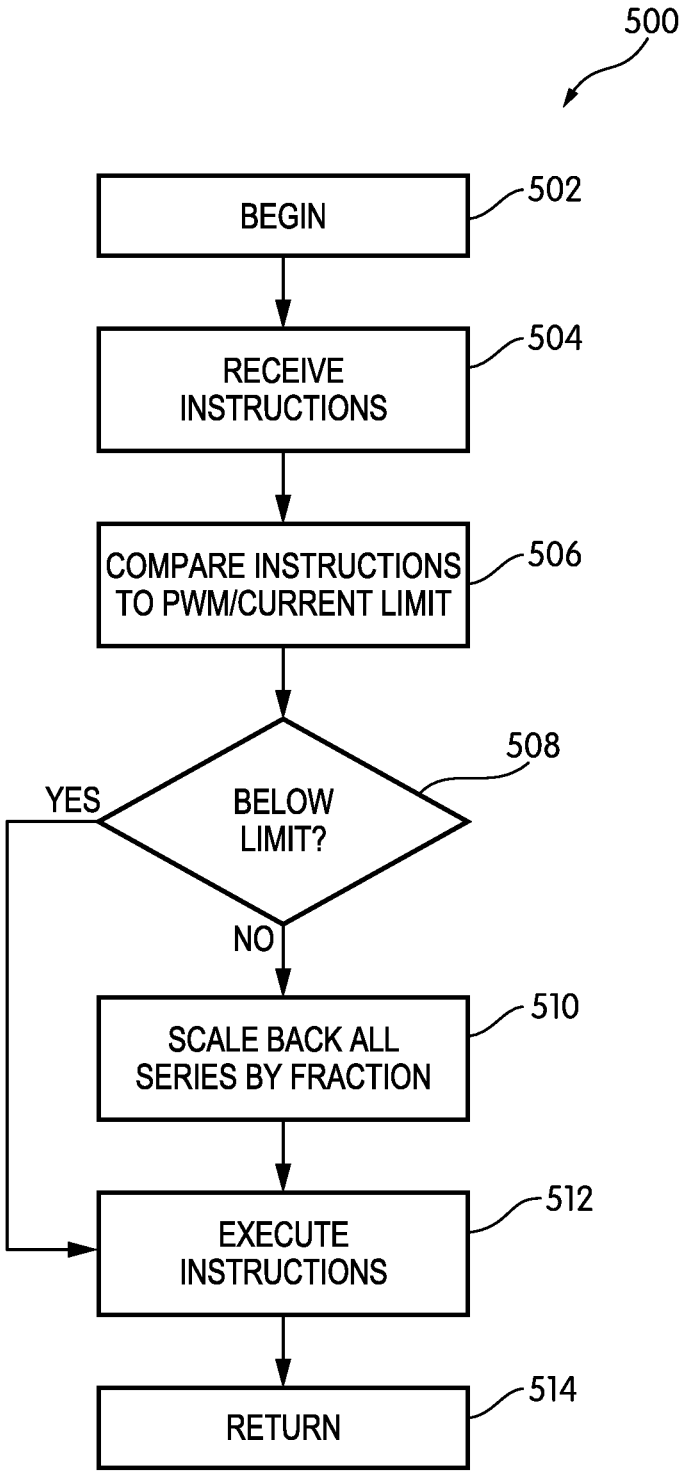
FIG. 15 is a schematic diagram of a method for imposing a power consumption limit on the LED light engines of a luminaire.

This basic method is generally indicated at 500 in FIG. 15 and begins at task 502. Method 500 is the type of method that would be executed by the central unit 104 any time the luminaire 10 is accepting instructions for driving the series of LED light engines R1 . . . B3. In task 504, a new instruction is received. This new instruction presumably commands a particular duty cycle for each of the series of LED light engines R1 . . . B3. In keeping with the description above, the description of method 500 will assume that that duty cycle is an 8-bit number from 0-255. Method 500 continues with task 506. In task 506, the duty cycle instructions are checked against a PWM/current limit threshold that is pre-set and programmed into the central unit 104. If the instructions are all below the pre-set limit (task 506:YES), the instructions are executed in task 512. If any of the instructions designate a duty cycle that would bring a series R1 . . . B3 above the pre-set limit (task 506:NO), method 500 continues with task 510. In task 510, an across-the-board scaling factor or fraction is applied to the duty cycles of all active series R1 . . . B3 to bring them all below the threshold. Method 500 completes and returns in task 514.

Power control methods are only one possible type of supervisory or control methods that may be executed by the central unit 104 and other components based on software instructions. Software may also be used to make color adjustments. For example, as was described above, the central unit 104 may intercede to offset particular color instructions to compensate for color or color temperature shifts due to encapsulation.

One particular area in which additional control may be useful is in transitions from one color or one type of LED light engine to another. For example, the linear luminaire 10 has both "cool white" and "warm white" LED light engines 16. As was explained above, these are blue-pump LED light engines with different phosphors that allow them to emit light with different overall color temperatures.

If one wishes to transition between "cool white" and "warm white," for example, it may seem logical simply to turn the cool white series CW1, CW2, CW3 off and turn the warm white series WW1, WW2, WW3 on. However, there can be problems with such transitions. The speed at which one makes such a transition is one issue, and a fast transition can cause problems of its own. However, transitions can create color problems as well.

Specifically, linear transitions from white light of one color temperature to white light of another color temperature run into a problem that becomes evident when one looks at a color chart, be it the CIE 1931, the CIE 1960, or the CIE 1976 color chart. On a color chart, the colors of natural "white" light all fall along a curve—the Planckian locus. That is, the Planckian locus is a curve on the CIE 1931, CIE 1960, and CIE 1976 color charts along which lie all of the colors that are emitted by blackbody radiators. While the light emissions of practical LED light engines 16 do not lie exactly along the Planckian locus, the color of light they emit is usually engineered to be as close to that of a blackbody radiator as possible. In the CIE color charts, the pink-hued colors lie below the Planckian locus, and the yellow and green-hued colors lie above it.

The straightest path between two points is a line. Yet, given the shape of the Planckian locus, if one implements a straight-line transition between one color temperature of white light and another, the light often acquires a pinkish hue during the transition. This hue appears unnatural to most observers and is thus undesirable.

For that reason, method 350 is a method for correcting transitions between one color temperature of light and another. Method 350 begins at task 352 and continues with task 354. In task 354, the central unit 104 receives instructions for activating one or more series of LED light engines R1 . . . B3. Those instructions may be received from an external device, such as a control computer or another linear luminaire 10, or they may be received (i.e., passed) from another control method that is also being executed by the central unit 104. If the central unit 104 is running multiple control methods, methods like method 350 that change the colors that are used will generally be run before methods like method 300 that determine how power is allocated among series of LED light engines R1 . . . B3. Method 350 continues with task 356.

Task 356 is a decision task. If the central unit 104 detects that the instructions necessitate a transition between white light of one color temperature and white light of another (task 356:YES), control of method 350 passes to task 358, and the central unit 104 corrects the instructions such that the transition occurs along the Planckian locus. This typically involves activating red, green, and blue colored LED light engines 16 in appropriate instants to create a nonlinear transition. Once that is done, or if no modifications are necessary because the instructions do not contain or imply a transition (task 356:NO), method 350 terminates and returns at task 360.

More generally, the design of the linear luminaire 10, with red, green, and blue LED light engines in addition to dedicated "white" LED light engines, has some specific advantages. For example, the linear luminaire 10 has dedicated cool white CW1, CW2, CW3 and warm white WW1, WW2, WW3 series of LED light engines. However, if desired, it is possible to use the RGB series of LED light engines R1 . . . B3 to interpolate between cool and warm to produce other color temperatures of white light. Potentially, any desired color temperature of white light could be produced by color mixing.

When producing white light of other color temperatures, it is likely that either the cool or the warm series of LED light engines CW1 . . . WW3 will be active along with red, green, or blue series R1 . . . B3, depending on the desired color temperature. The central unit 104 can be calibrated or otherwise set, given the particular characteristics of the linear luminaire, to produce mixed white lights of arbitrary color temperatures that are as close to the Planckian locus as possible. (That is, in formal terms, the Duv of the light relative to the Planckian locus should be minimized.)

As those of skill in the art may appreciate, the ability to mix RGB light precisely would also allow the central unit 104 to compensate for blue-pump white light LED light engines with suboptimal characteristics, for example, warm white LED light engines with a large Duv or a low color rendering index (CRI). This, in turn, may allow for the use of less desirable, and thus less expensive, white LED light engines.

If red, green, and blue lights are mixed to create or augment white light, that mixing may be controlled by a method like method 350 in order to keep the emitted light along the Planckian locus to avoid any unnatural colors during startup or transition.

Other supervisory and control methods may be implemented for purposes of safety, or in order to ensure the longevity of the luminaire 10. For example, the boost converter 204 will work with very low input voltages, e.g., under 5 volts. In boosting these low voltages, the boost converter 204 may draw so much current that the input harness 202 exceeds its rated ampacity. To avoid these issues, the central unit 104 or the regulator IC 210 may be programmed not to allow the luminaire 10 to function unless the voltage in the input harness 202 exceeds a threshold, e.g., 19V.

Another possible safety or longevity issue is heat. If the luminaire 10 gets too hot, it may damage the PCB 18 and the electronics. For that reason, luminaires according to embodiments of the invention may include at least one temperature sensor. In the illustrated embodiment, the luminaire 10 includes two temperature sensors 103, 107 connected to the central unit 104. These two temperature sensors 103, 107 may be in different locations within the luminaire 10. For example, one temperature sensor 103 may be positioned to read the temperature on the PCB 18, while the other temperature sensor 107 may be positioned to read the temperature at or near the stand-offs 30 that serve as heat sinks. The temperature sensors 103, 107 may be, for example, thermistors.

Figure 16:
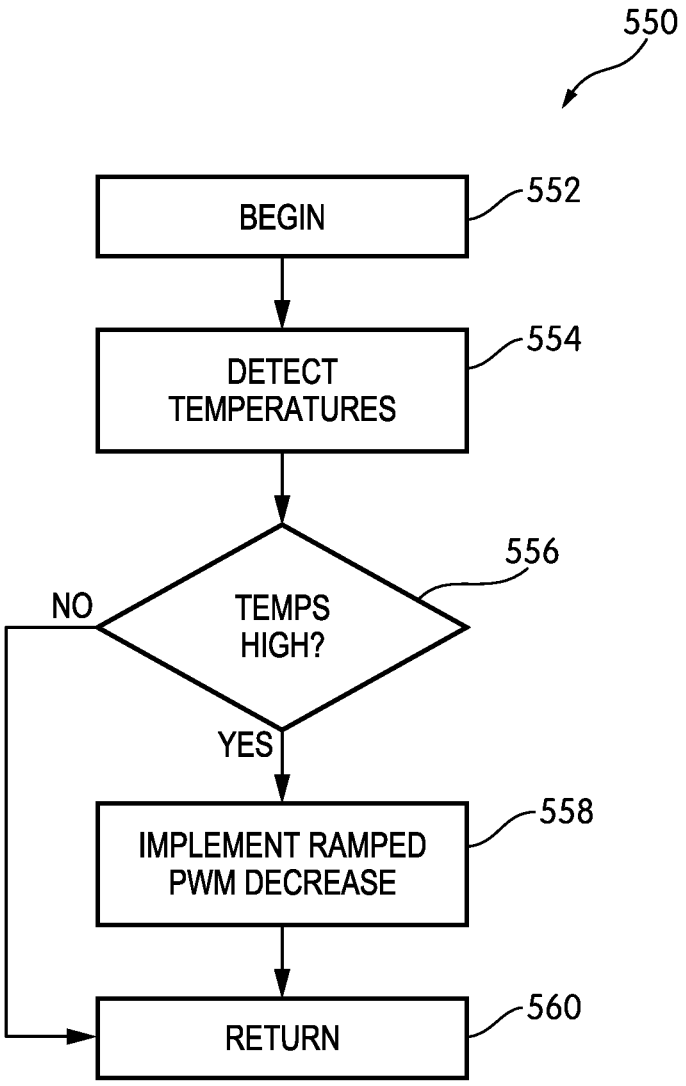
FIG. 16 is a schematic diagram of a method for controlling the temperature of a linear luminaire by controlling the power consumption of LED light engines installed in the linear luminaire.

The central unit 104 may be programmed to read and use the data from the temperature sensors 103, 105 in specific ways. FIG. 16 is a flow diagram of one such method, generally indicated at 550. Method 550 begins at task 552 and continues with task 554, in which the temperatures are read from the temperature sensors 103, 107. Method 550 then continues with task 556, a decision task. In task 556, if the temperatures are too high as compared with pre-set thresholds (task 556:YES), method 550 continues with task 558. If not (task 556:NO), method 550 returns at task 560.

In task 558, the central unit 104 implements the kind of across-the-board decrease in the PWM duty cycle of each active series of LED light engines R1 . . . B3 that was described above. This helps to ensure that color change or shift caused by the decrease will be minimal to none. While the central unit 104 may implement this decrease instantaneously, by instructing the PWM duty cycle of each series R1 . . . B3 to fall immediately to some fraction of its original instructed duty cycle (e.g., 90%, 80%, etc.), this has particular disadvantages. For example, immediate decrease in intensity of the series of LED light engines R1 . . . B3 could be perceived by the human eye as flicker. For that reason, in task 558, the central unit 104 preferably implements a gradual, ramped decrease in duty cycle to the target. The rate of decrease of that ramp may vary, but it should be slow enough that the human eye will not perceive the change as flicker.

In this description, the term "about," when applied to a number or value, should be construed to mean that that number or value can vary somewhat, as long as the variation does not affect the described circumstances or result. As one example, when describing color temperatures of white light, variations of up to 300K are accepted in some contexts in industry. If it cannot be determined what value or threshold would change the described circumstances, the term "about" should be construed to mean the stated value plus or minus 5%. As those of skill in the art will realize, the stated values of resistors, capacitors, and other circuit elements have their own tolerances. Unless otherwise stated, the tolerances for circuit elements should be construed to be ±1%.

While the invention has been described with respect to certain embodiments, the description is intended to be exemplary, rather than limiting. Modifications and changes may be made within the scope of the invention, which is defined by the appended claims.

What is claimed is:

1. A linear luminaire, comprising:

a channel comprising a bottom and sidewalls that arise from opposite sides of the bottom, the channel having an upper compartment and a lower compartment, the sidewalls being of a shape and extent such that at opposite ends of the channel, the upper compartment overhangs the lower compartment in a longitudinal direction; and an elongate, rigid printed circuit board (PCB) mounted in the upper compartment of the channel, aligned along the longitudinal direction, the PCB extending to each of the opposite ends of the channel in the upper compartment and having one or more LED light engines mounted thereon.

2. The linear luminaire of claim 1, wherein the PCB is mounted on stand-offs that extend between the bottom of the channel and the PCB, a height of the stand-offs positioning the PCB in the upper compartment of the channel.

3. The linear luminaire of claim 2, wherein the PCB defines a boundary between the lower compartment and the upper compartment.

4. The linear luminaire of claim 1, wherein the PCB comprises multiple sections with a male connector on the underside of the PCB on a first side of a joint between the multiple sections and a female connector on the underside of the PCB on a second side of the joint between the multiple sections.

5. The linear luminaire of claim 1, wherein the lower compartment comprises one or more ports.

6. The linear luminaire of claim 1, wherein at each of the opposite ends of the channel, the lower compartment comprises an opening or a knock-out for an opening.

7. The linear luminaire of claim 1, further comprising a resin filling and encapsulating the channel.

8. The linear luminaire of claim 1, wherein the one or more LED light engines comprise one or more sets of LED light engines, each of the one or more sets of LED light engines emitting a different color of light.

9. A linear luminaire system, comprising:

a first luminaire, including a first channel comprising a bottom and sidewalls that arise from opposite sides of the bottom, the first channel having an upper compartment and a lower compartment, the sidewalls of the first channel being of a shape and extent such that at opposite ends of the first channel, the upper compartment overhangs the lower compartment in a longitudinal direction, and an elongate, rigid first printed circuit board (PCB) mounted in the upper compartment of the first channel, aligned along the longitudinal direction, the PCB extending to each of the opposite ends of the first channel in the upper compartment thereof and having one or more first LED light engines mounted thereon; and a second luminaire, including a second channel comprising a bottom and sidewalls that rise from opposite sides of the bottom, the second channel having an upper compartment and a lower compartment, the sidewalls of the second channel being of a shape and extent such that at opposite ends of the first channel, the upper compartment overhangs the lower compartment in the longitudinal direction, and an elongate, rigid second PCB mounted in the upper compartment of the second channel, aligned along the longitudinal direction, the second PCB extending to each of the opposite sides of the second channel in the upper compartment thereof and having one or more second LED light engines mounted thereon;

wherein the first luminaire and the second luminare are abutted along the longitudinal direction such that the overhung upper compartment of the first luminaire and the overhung upper compartment of the second luminaire create a space therebetween below the abutted first and second upper compartments.

10. The linear luminaire system of claim 9, wherein at each of the opposite ends of the channel, the lower compartment comprises an opening or a knock-out for an opening.

11. The linear luminaire system of claim 9, wherein the first PCB is mounted on stand-offs that extend between the bottom of the first channel and the first PCB, a height of the stand-offs positioning the first PCB in the upper compartment of the first channel.

12. The linear luminaire system of claim 11, wherein the second PCB is mounted on second stand-offs that extend between the bottom of the second channel and the second PCB, a height of the second stand-offs positioning the second PCB in the upper compartment of the second channel.

13. The linear luminaire system of claim 12, wherein the first PCB and the second PCB define boundaries between the lower compartment and the upper compartment of the first channel and the lower compartment and the upper compartment of the second channel, respectively.

14. The linear luminaire system of claim 9, further comprising a resin filling one or both of the first channel and the second channel.

15. The linear luminaire system of claim 9, wherein the one or more LED light engines of the first PCB and the one or more light engines of the second PCB each comprise one or more sets of LED light engines, each of the one or more sets of LED light engines of the first PCB emitting a different color of light from others of the one or more sets of LED light engines of the first PCB, and each of the one or more sets of LED light engines of the second PCB emitting a different color of light from others of the one or more sets of LED light engines of the second PCB.

* * * * *